US008746333B2

(12) United States Patent
Zolezzi-Garreton

(10) Patent No.: US 8,746,333 B2
(45) Date of Patent: Jun. 10, 2014

(54) SYSTEM AND METHOD FOR INCREASING PRODUCTION CAPACITY OF OIL, GAS AND WATER WELLS

(75) Inventor: Alfredo Zolezzi-Garreton, Vina del Mar (CL)

(73) Assignee: Technological Research Ltd, Tortola (VG)

( * ) Notice: Subject to any disclaimer, the term of this patent is extended or adjusted under 35 U.S.C. 154(b) by 512 days.

(21) Appl. No.: 12/954,906

(22) Filed: Nov. 28, 2010

(65) Prior Publication Data

US 2011/0127031 A1 Jun. 2, 2011

Related U.S. Application Data

(60) Provisional application No. 61/283,195, filed on Nov. 30, 2009.

(51) Int. Cl.
*E21B 28/00* (2006.01)
*E21B 43/25* (2006.01)

(52) U.S. Cl.
USPC ..... 166/177.1; 166/177.6; 166/249

(58) Field of Classification Search
USPC ..... 166/177.1, 177.6, 249, 369
See application file for complete search history.

(56) References Cited

U.S. PATENT DOCUMENTS 3,520,362 A * 7/1970 Galle ..... 166/249
3,527,300 A * 9/1970 Phillips ..... 166/249
3,583,677 A * 6/1971 Phillips ..... 366/120
3,648,769 A 3/1972 Sayer
3,990,512 A 11/1976 Kuris
4,164,978 A * 8/1979 Scott ..... 166/249
4,280,557 A 7/1981 Bodine
4,343,356 A 8/1982 Riggs
4,345,650 A * 8/1982 Wesley ..... 166/249
4,538,682 A 9/1985 McManus
4,997,044 A * 3/1991 Stack ..... 166/385
5,004,050 A * 4/1991 Sizonenko et al. ..... 166/248
5,109,922 A * 5/1992 Joseph ..... 166/65.1
5,184,678 A * 2/1993 Pechkov et al. ..... 166/249
5,282,508 A * 2/1994 Ellingsen et al. ..... 166/249
5,595,243 A 1/1997 Maki, Jr.
5,713,415 A * 2/1998 Bridges ..... 166/60
5,994,818 A 11/1999 Abramov
6,009,948 A * 1/2000 Flanders et al. ..... 166/301

(Continued)

FOREIGN PATENT DOCUMENTS

RU 2026969 1/1995

OTHER PUBLICATIONS

"Steel Wire Armoured Cable", http://en.wikipedia.org/wiki/Steel_wire_armoured_cable, downloaded Mar. 28, 2013.*

(Continued)

*Primary Examiner* — Jennifer H Gay
(74) *Attorney, Agent, or Firm* — Karim Lagobi

(57) ABSTRACT

A method and system for stimulating production of a natural resource (e.g., Oil, gas or water) producing well using vibrational energy delivered to the geological formation through a downhole type apparatus that maybe permanently installed, and continuously or periodically operated even during recovery of the natural resource. The apparatus is constructed to resist corrosion and provides one or more heat sink chambers for controlling heat dissipation during operation. The system is capable of monitoring production, adapting stimulation parameters based on user input and other pertinent parameters.

24 Claims, 23 Drawing Sheets

(56) References Cited

U.S. PATENT DOCUMENTS

| | | | | |
|---|---|---|---|---|
| 6,012,521 | A * | 1/2000 | Zunkel et al. | 166/249 |
| 6,186,228 | B1 * | 2/2001 | Wegener et al. | 166/249 |
| 6,227,293 | B1 * | 5/2001 | Huffman et al. | 166/248 |
| 6,230,799 | B1 | 5/2001 | Slaughter | |
| 6,279,653 | B1 | 8/2001 | Wegener | |
| 6,390,191 | B1 * | 5/2002 | Melson et al. | 166/177.1 |
| 6,405,796 | B1 | 6/2002 | Meyer | |
| 6,427,774 | B2 * | 8/2002 | Thomas et al. | 166/248 |
| 6,429,575 | B1 | 8/2002 | Abramov | |
| 6,619,394 | B2 * | 9/2003 | Soliman et al. | 166/249 |
| 7,059,403 | B2 * | 6/2006 | Barrientos et al. | 166/249 |
| 7,063,144 | B2 | 6/2006 | Abramov | |
| 7,213,681 | B2 * | 5/2007 | Birchak et al. | 181/121 |
| 7,216,738 | B2 * | 5/2007 | Birchak et al. | 181/121 |
| 7,503,404 | B2 * | 3/2009 | McDaniel et al. | 175/57 |
| 7,591,343 | B2 * | 9/2009 | Han et al. | 181/108 |
| 7,644,759 | B2 * | 1/2010 | Davidson | 166/249 |
| 7,677,673 | B2 * | 3/2010 | Tranquilla et al. | 299/2 |
| 7,823,638 | B2 * | 11/2010 | Ellingsen | 166/177.2 |
| 2001/0011590 | A1 * | 8/2001 | Thomas et al. | 166/248 |
| 2002/0070017 | A1 * | 6/2002 | Soliman et al. | 166/249 |
| 2005/0006088 | A1 * | 1/2005 | Abramov et al. | 166/249 |
| 2006/0016606 | A1 * | 1/2006 | Tubel et al. | 166/386 |
| 2006/0096752 | A1 * | 5/2006 | Barrientos et al. | 166/249 |
| 2006/0180386 | A1 * | 8/2006 | Birchak et al. | 181/121 |
| 2006/0181960 | A1 * | 8/2006 | Birchak et al. | 367/157 |
| 2007/0045038 | A1 * | 3/2007 | Han et al. | 181/113 |
| 2007/0064539 | A1 * | 3/2007 | Han et al. | 367/189 |
| 2007/0256828 | A1 * | 11/2007 | Birchak et al. | 166/249 |
| 2008/0073079 | A1 * | 3/2008 | Tranquilla et al. | 166/270.1 |
| 2009/0200019 | A1 * | 8/2009 | DeLaCroix et al. | 166/249 |
| 2009/0242205 | A1 * | 10/2009 | Coste et al. | 166/308.1 |
| 2010/0163227 | A1 * | 7/2010 | Tranquilla et al. | 166/270.1 |
| 2010/0300681 | A1 * | 12/2010 | Dai | 166/249 |
| 2011/0011576 | A1 * | 1/2011 | Cavender et al. | 166/177.1 |
| 2011/0094732 | A1 * | 4/2011 | Lehman et al. | 166/249 |
| 2011/0127031 | A1 * | 6/2011 | Zolezzi Garreton | 166/249 |
| 2011/0139440 | A1 * | 6/2011 | Zolezzi-Garreton | 166/249 |
| 2011/0139441 | A1 * | 6/2011 | Zolezzi Garreton | 166/249 |
| 2011/0220411 | A1 * | 9/2011 | Dupont | 175/50 |
| 2012/0018167 | A1 * | 1/2012 | Konopczynski et al. | 166/369 |
| 2012/0061077 | A1 * | 3/2012 | Fraim et al. | 166/249 |
| 2012/0132416 | A1 * | 5/2012 | Zolezzi-Garreton | 166/249 |

OTHER PUBLICATIONS

Igor A. Beresnev, Elastic-wave Stimulation of Oil Production: A Review of Methods and Results, Jun. 1994, Geophysics, vol. 59, No. 6 (Jun. 1994); p. 1000-1017, 15 Figs., 3 Tables—18 pages.

Dr. Franklin Foster, Recovering Heavy Oil—Future Challenges and Opportunities, 2006, Foster Learning, Inc., 1 page.

* cited by examiner

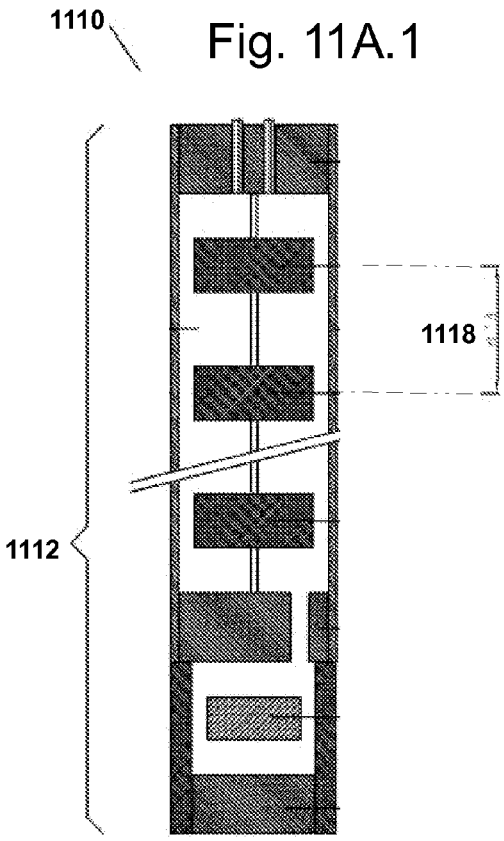
Fig. 11A.1
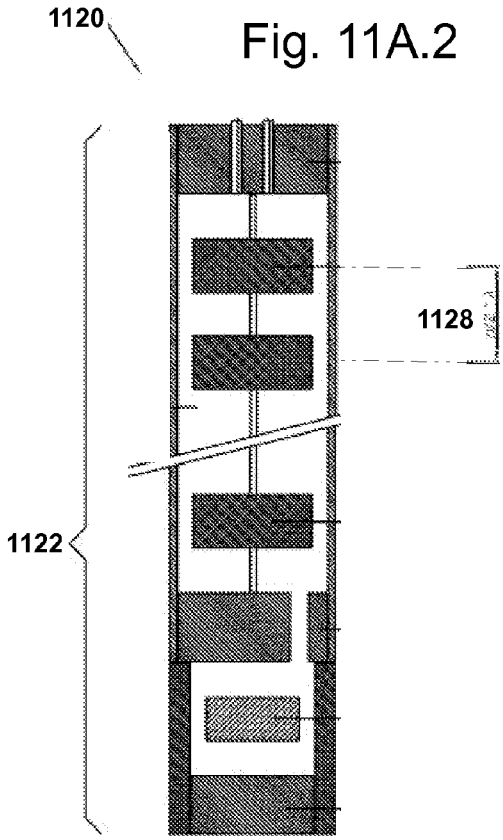
Fig. 11A.2
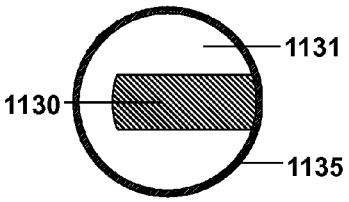
Fig. 11B.1
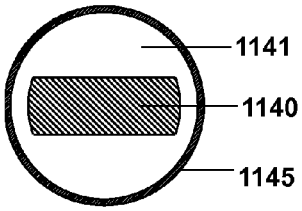
Fig. 11B.2
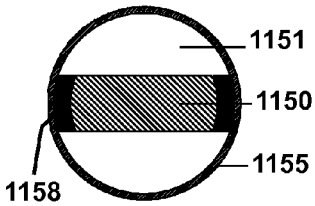
Fig. 11B.3

SYSTEM AND METHOD FOR INCREASING PRODUCTION CAPACITY OF OIL, GAS AND WATER WELLS

FIELD OF THE INVENTION

The invention relates to recovering natural resources such as oil and natural gas from a geological formation; particularly the invention related to a system and method for stimulating the flow of the natural resource toward the recovery zone, i.e. wells, utilizing high-power elastic waves and a monitoring system to collect data for optimizing the system's performance.

A portion of the disclosure of this patent document contains material which is subject to copyright protection. The copyright owner has no objection to the facsimile reproduction by anyone of the patent document or the patent disclosure, as it appears in the Patent and Trademark Office file or records, but otherwise reserves all copyrights associated with this document.

BACKGROUND OF THE INVENTION

There exist several extraction methods to improve productivity from oil wells. However in the upstream crude oil industry, 60% to 70% of OOIP (Original Oil In Place) are typically left in the reservoir after the use of normal primary and secondary recovery techniques (Society of Petroleum Engineers. www.spe.org). The benefits of improving extraction methods are substantial. For example, there are thousands of oil wells in Texas, USA, alone, which could benefit from improving oil production output. If it were possible to recover even 50% of the heavy oil deposits, the US could supply 50% of North American demand for another 50 to 75 years (Dr. Franklin Foster, 2006).

A well for extracting fluids from geological formations is constructed by drilling a hole from the surface toward the geological formation that contains a natural resource, and that has adequate permeability to let fluids produced in the formation flow toward the well. The well's walls are lined with a cement layer and a casing that houses and supports a production tube string coaxially installed in its interior. In addition, perforations are made in the well lining in order to connect the well with the reservoir, supplying a path or trajectory inside the formation. Tubes provide an outlet for the fluids obtained from the formation.

Typically, there are numerous perforations that extend radially from the lined or coated well. Perforations are uniformly separated in the lining, and pass to the outside of the lining through the formation. In an ideal case, perforations are only located within the formation, and their number depends on the formation thickness. It is rather common to have nine, and up to twelve perforations per depth meter of formation. Other perforations extend longitudinally, and yet other perforations may extend radially from a 0°-azimuth, while additional perforations, located every 90° may define four sets of perforations around azimuth. Formation fluids pass through these perforations and come into the lined (or coated) well.

Preferably, the oil well is plugged by a sealing mechanism, such as a shutter element, or with a bridge-type plug, located below the level of perforations. This shutter element is connected to a production tube, and defines a compartment. The production fluid, coming from the formation or reservoir, enters the compartment and fills the compartment until it reaches a fluid level. Accumulated oil, for example, flows from the formation and can be accompanied by variable quantities of natural gas. Hence, the lined compartment may contain oil, some water, natural gas, and solid particles, with normally, particles settling at the bottom of the compartment.

The fluid produced in the formation may change its phase when there is a reduction of pressure around the well; this change of phase causes the gasification of the lightest molecules. Also, the oil well can produce very heavy molecules. Over time, due to several reasons, oil well productivity gradually diminishes. Two main causes of the reduction in productivity are related to relative permeability: a decrease of the fluidity of crude oil, and the deposit of solids in the perforations.

Crude oil's fluidity diminishes over time and progressively obstructs pores in a deposit or reservoir. On the other hand, solids such as clays, colloids, salts, paraffin etc. accumulate in perforation zones of the well. These solids reduce the absolute permeability, or interconnection between pores. Problems associated with the causes mentioned above are: obstruction of pores by mineral particles that flow jointly with the fluid to be extracted, precipitation of inorganic scales, decanting of paraffins and asphalt or bitumen, hydration of clay, invasion of solids from the mud and filtration of perforation mud, as well as invasion of termination fluids and solids from brine injections. Each of the above mentioned causes can produce a permeability reduction, or a flow restriction in the zone surrounding oil well perforations. This defines the pore size connecting to the fluid inside formation, allowing the fluid flow from the formation through cracks or fissures, or connected pores, and finally the fluid comes to interstitial spaces within the compartment and is collected. During that flow, very small solid particles from the formation, called "fines," may flow; but instead they tend to settle.

After a certain time, trajectories through perforations extending inside the formation of a reservoir may become obstructed with "fines" or residues. While the "fines" can be kept in a disperse state for some time, they can agglomerate and plug the pore space, reducing the fluid rate or production quantity. This may become a problem that is fed back to the well and cause a production decrease. More and more "fines" can keep settling on perforations, plugging them more and more, even tending to halt a minimum flow rate.

There exist several treatment methods to improve productivity from oil wells. Periodic stimulation of oil and gas wells is done by applying three general types of treatment: acid treatment, fracturing, and default treatment with solvents and heat. Acid treatment consists of using mixtures of acids HCl and HF (hydrochloric acid and hydrofluoric acid), which is injected in the production zone (rock). Acid is used for dissolving reactive components (carbonates, clay minerals, and in a smaller quantity, silicates) in the rock, thus increasing permeability. Frequently, additives are incorporated, such as reaction retarding agents and solvents, to improve acid performance in the acidizing operation.

While acid treatment is a common treatment to stimulate oil and gas wells, this treatment has multiple drawbacks. The cost of acids and the cost of disposing of production wastes are high; acids are often incompatible with the crude oil, and may produce viscous oily residues inside the well; precipitates formed once the acid is consumed, can often be more obnoxious than dissolved minerals; and the penetration depth of active or live acid is generally less than 5 inches (12.7 cm).

Hydraulic fracturing is another technique usually used for stimulating oil and gas wells. In this process, high hydraulic pressures are used to produce vertical fractures in the formation. Fractures can be filled with polymer plugs, or treated with acid (in rocks, carbonates, and soft rocks), to form permeability channels inside the wellbore region; these channels allow oil and gas to flow. However, the cost of hydraulic fracturing is extremely high (as much as 5 to 10 times higher than acid treatment costs). In some cases, fracture may extend inside areas where water is present, thus increasing the quantity of water produced (a significant drawback for oil extraction). Hydraulic fracture treatments extend several hundred meters from the well, and are used more frequently when rocks are of low permeability. The possibility of forming successful polymer plugs in all fractures is usually limited, and problems such as plugging of fractures and grinding of the plug may severely deteriorate productivity of hydraulic fractures.

Another method for improving oil production in wells involves injecting steam. One of the most common problems in depleted oil wells is precipitation of paraffin and asphaltenes or bitumen inside and around the well. Steam has been injected in these wells to melt and dissolve paraffin into the oil or petroleum, and then all the mixture flows to the surface. Frequently, organic solvents are used (such as xylene) to remove asphaltenes or bitumen whose melting point is high, and which are insoluble in alkanes. Steam and solvents are very costly (solvents more so than steam), particularly when marginal wells are treated, producing less than 10 oil barrels per day (1 bbl=159 liters). The main limitation for use of steam and solvents is the absence of mechanical mixing, which is required for dissolving or maintaining paraffin, asphaltenes or bitumen in suspension.

Several other methods have been described to increase oil well output. Challacombe (U.S. Pat. No. 3,721,297) describes a tool for cleaning wells using pressure pulses: a series of explosive and gas generator modules are interconnected in a chain, in such a manner that ignition of one of them triggers the next one and a progression or sequence of explosions is produced. These explosions generate shock waves that clean the wells. There are obvious disadvantages of this method, such as potential damage that can be caused to high-pressure oil and gas wells.

Sawyer (U.S. Pat. No. 3,648,769) describes a hydraulically controlled diaphragm that produces "sinusoidal vibrations in the low acoustic range". Generated waves are of low intensity, and are not directed or focused to face the formation (rock). As a consequence, the major part of energy is propagated along the well axis.

Riggs et al. (U.S. Pat. No. 4,343,356) describes an apparatus for treating shallow wells. Application of a high voltage produces voltage arcs that liberate from the well walls the encrusted material. Among difficulties with this apparatus there is the fact that it is not possible to continually guide the electric arc for achieving a real cleaning of the well. Additionally, safety aspects have not been solved (electrical and fire problems).

Bodine (U.S. Pat. No. 4,280,557) proposes another hydraulic/mechanical oscillator where pulses of hydraulic pressure, created, inside an elastic elongated tube, are used for cleaning encased well walls.

Mac Manus et al. (U.S. Pat. No. 4,538,682) disclosed a method for removing paraffin from oil wells by introducing a heating element into an oil well in order to establish a temperature gradient within the well.

It is known that oil, gas, and water wells are plugged after certain operating time; the fluid discharge diminishes and it becomes necessary to regenerate these wells. Mechanical, chemical, and conventional techniques to regenerate wells include: intensive rinsing, pumping hammer and hydraulic treatment.

Dissolution of sediments using hydrochloric acid, or other acids, mixed with other chemical agents include: Hosing down with high-pressure water, carbon dioxide injection, and generation of pressure shocks using explosives.

Ultrasound techniques have been developed to increase production of crude oil from wells. However, there is a great amount of effects associated with exposing solids and fluids to an ultrasound field of certain frequencies and energy. In the case of fluids in particular, cavitation bubbles can be generated. These are bubbles of gas dissolved in liquid, or bubbles of the gaseous state of this liquid (change of phase). Other associated phenomena are liquid degassing and cleaning of solid surfaces.

Arthur Kuris, in "Method and Apparatus for Fracturing Rock and the Like" (U.S. Pat. No. 3,990,512), discloses a method for recovering oil by application of ultrasound generated when injecting high-pressure fluids, whose purpose is to fracture the deposit to produce new draining channels.

Maki Jr. et al. (U.S. Pat. No. 5,595,243) propose an acoustic device in which a piezoceramic transducer is set as radiator. The device presents difficulties in its manufacturing and use, because an asynchronous operation is required of a high number of piezoceramic radiators.

Vladimir Abramov et al., in "Device for Transferring Ultrasonic Energy to a Liquid or Pasty Medium" (U.S. Pat. No. 5,994,818) and in "Device for Transmitting Ultrasonic Energy to a Liquid or Pasty Medium" (U.S. Pat. No. 6,429,575), propose an apparatus consisting of an alternating current generator operating within the range of 1 to 100 kHz to transmit ultrasonic energy, and a piezoceramic or magnetostrictive transducer emitting ultrasound waves, which are transformed by a tubular resonator or waveguide system (or sonotrode) in transversal oscillations that contact the irradiated liquid or pasty medium. However, these systems are conceived to be used in containers of very large dimensions, at least as compared with the size and geometry of perforations present in wells. This shows limitations from a dimensional point of view, and also for transmission mode if it is desired to enhance production capacities of oil wells.

Julie C. Slaughter et al., in "Ultrasound Radiator of Downhole Type and Method for Using It" (In U.S. Pat. No. 6,230,788), propose a device that uses ultrasonic transducers manufactured of Terfenol-D alloy and placed at the well bottom, and fed by an ultrasonic generator located at the surface. Location of transducers, axially to the device, allows the emission along a transversal direction. This invention proposes a viscosity reduction of hydrocarbons contained in the well through emulsification, when reacting with an alkaline solution injected to the well. This device considers a forced shallow circulation of fluid as a refrigeration system, to warrant continuity of irradiation.

Dennos C. Wegener et al., in "Heavy Oil Viscosity Reduction and Production," (U.S. Pat. No. 6,279,653), describe a method and a device for producing heavy oil (API specific gravity less than 20) applying ultrasound generated by a transducer made of Terfenol alloy, attached to a conventional extraction pump, and powered by a generator installed at the surface. In this invention the presence of an alkaline solution is also considered, similar to an aqueous sodium hydroxide (NaOH) solution, to generate an emulsion with crude oil of lower density and viscosity, thereby facilitating recovery of the crude by impulsion with a pump. Here, a transducer is installed in an axial position to produce longitudinal ultrasound emissions. The transducer is connected to an adjacent rod that operates as a waveguide or sonotrode.

Robert J. Meyer et al. , in "Method for improving Oil Recovery Using an Ultrasonic Technique" (U.S. Pat. No 6,405,796), propose a method to recover oil using an ultrasound technique. The proposed method consists of disintegration of agglomerates by means of an ultrasonic irradiation technique, and the operation is proposed within a certain frequency range, for the purpose of handling fluids and solids in different conditions. Main oil recovery mechanism is based in the relative momentum of these components within the device.

The above-mentioned prior art using ultrasonic waves via a transducer, externally supplied by an electric generator and the transmission cable generally is longer than 2 km. This has the disadvantage of signal transmission losses, which means that a signal must be generated to have enough intensity (or energy) for an adequate operation of transducers within the well, since high-frequency electric current transmission to such depths is reduced to 10% of its initial value. Furthermore, since transducers need to operate at a high-power regime, water or air cooling system is required, which poses great difficulties when placed inside the well. The latter implies that ultrasound intensity must not exceed 0.5-0.6 W/cm2. This level is insufficient for the desired purposes, because threshold of acoustic effects in oil and rocks is from 0.8 to 1 W/cm2.

Andrey a. Pechkov, in "Method for Acoustic Stimulation of Wellbore Bottom Zone for Production Formation" (RU Patent No. 2,026,969), disclose methods and devices for stimulating production of fluids within a producing well. These devices incorporate, as an innovating element, an electric generator attached to the transducer, and both of them integrated in the well bottom. These transducers operate in a non-continuous mode, and can operate without needing an external cooling system. The impossibility of operating in a continuous mode to prevent overheating is one of the main drawbacks of this implementation since the availability of the device is reduced. Moreover, as the generator is located in the well bottom, this equipment maintenance cost rises as it is likely to fail, especially when working in high power applications.

Oleg Abramov et al., in "Acoustic Method for Recovery of Wells, and Apparatus for its Implementation" (U.S. Pat. No. 7,063,144), disclose an electro-acoustic method for stimulation of production within an oil well. The method consists of stimulating, by powerful ultrasound waves, the well extraction zone, causing an increase of mass transfer through its walls. This ultrasonic field produces large tension and pressure waves in the formation, thus facilitating the passage of liquids through well orifices. It also prevents accumulation of "fines" on these holes, thereby increasing the life of the well and its extraction capacity.

Some problems encountered in the solutions proposed by Robert J. Meyer et al., in "Method for improving Oil Recovery Using an Ultrasonic Technique" (U.S. Pat. No 6,405,796), Andrey A. Pechkov, in "Method for Acoustic Stimulation of Wellbore Bottom Zone for Production Formation" (RU Patent No. 2,026,969), Dennos C. Wegener et al., in "Heavy Oil Viscosity Reduction and Production," (U.S. Pat. No. 6,279,653), Oleg Abramov et al., in "Acoustic Method for Recovery of Wells, and Apparatus for its Implementation" (U.S. Pat. No. 7,063,144) and Julie C. Slaughter et al., in "Ultrasound Radiator of Dowhole Type and Method for Using It" (In U.S. Pat. No. 6,230,788), are:

a) some devices to be introduced in the well containing the ultrasound radiator are sensible to degradation by hydrocarbons and corrosion by acids present at the well bottom;

b) some devices are not intended to be used in oil/water wells with high content or presence of gas, due to their almost null capacity to dissipate the heat generated by the mechanic wave radiators when said radiators are not in contact with liquid fluids, situation that eventually will destroy the radiators or other components (cables, wires, coils, others); and c) some devices are not meant to be used in Gas Reservoirs or Gas wells.

d) some devices have associated environmental treatment costs due to the use of chemicals.

Therefore, what is needed is a method, apparatus and system for improving well productivity that does not present (or at least minimizes) the drawbacks of the existing technologies. The invention provides a system, apparatus and method for increasing production capacity of oil, gas and water wells.

SUMMARY OF THE INVENTION

The invention provides a system, an apparatus and methods for increasing productivity of a natural resource producing-well. The invention provides an apparatus that utilizes one or more elastic-waves generators hosted inside a chamber. The chamber is made of (or protected by) a corrosion-resistant material, that allow the apparatus to be efficiently used in harsh chemical environments.

The invention provide a highly efficient and versatile means to increase the mobility of fluids within the well bore region of an oil/water/gas well. The method and system may be adapted to the geology of the reservoir. In one embodiment of the invention, the system utilizes an acoustic device of the "downhole" type, that is, at the bottom of the well and/or the perforated zone of the well, to generate mechanical waves of an extremely high energy. Such high energy is capable of removing deposits of fines, organics, scales and inorganic deposits inside the well and in the wellbore region. A device implementing the invention may have an insulated and controlled-environment chamber, for protection against mechanical waves generated by the acoustic generators, and against corrosion by hydrocarbons. present in the formation, and from high temperature. The later configuration allows for the installation of several types of sensors and devices to acquire data from the well bottom, wellbore and/or the perforated zone.

One or more embodiments of the invention deliver an acoustic device for oil, gas, and water well, which does not require injection of chemicals for their stimulation.

One of the advantages of the invention compared to prior art is that the system delivers an acoustic device for downhole that has no environmental burden that is typically associated with treatment with liquids which are typically returned to the well after the treatment.

The invention provides an acoustical device for stimulating wells in the perforation zone (downhole) that can operate inside a tube without needing the withdrawal or elimination said tube. Alternatively, the device may be coupled to the tube using an adapter, in order to operate while being during production.

The regime of operation in accordance with the invention may be adapted to the type of well (e.g., Oil, Gas or any combination of both), to type geology and all other aspects of factors that limit the production in a well. The method and system embodying the invention are highly versatile and may be adapted for use specifically to treat any of a plurality of conditions. Embodiments of the invention may comprise an acoustic device capable of being used in one or more different types of reservoirs, crude type, gas content, and combined environments. The acoustic device may operate with an corrosion-resistant heatsink chamber that emits and/or radiates power as elastic waves directed to the formation, and that likewise avoids the contact of hydrocarbons and other fluids with the radiator and other inner components of the system preventing corrosive damage.

Another embodiment of the invention provides a corrosion-resistant heatsink chamber that acts as an acoustic resonance chamber. The invention takes into account the disposition of the wave generator and provides a plurality of geometries that are adequate to address a plurality of conditions. The corrosion-resistant heatsink chamber also prevents the system from overheating, by means of a heatsink liquid which fills the device, allowing the system to work in gas reservoirs or oil wells with high concentration of gas. When working in heavy oil wells, the capacity to efficiently transfer the heat generated by the wave radiators to the environment, also improves the capacity of the system to reduce the viscosity of the crude oil, for example, thus facilitating the crude oil flow and extraction.

Furthermore, an embodiment of the invention provides a device that allows the connection of one or more acoustic devices in a single well, thus allowing an installation that fulfills the specific requirements for each well.

BRIEF DESCRIPTION OF THE DRAWINGS

FIGS. 11A.1 and 11A.2 illustrate examples of geometries for the layout of a plurality of acoustic wave sources hosted within one or more devices implementing the invention.

FIGS. 11B.1, 11B.2 and 11B.3 illustrate geometries of various dispositions of a acoustic wave source with regard to the wall of the chamber in accordance with one or more embodiments of the invention.

DETAILED DESCRIPTION OF THE INVENTION

The invention provides an apparatus, method and system for increasing production capacity of oil, gas and water wells utilizing a versatile device that is adaptable to various applications. The invention also provides methods and a system to use the device in various exploitation reservoirs that have various geologies.

In the following description, numerous specific details are set forth to provide a more thorough description of the invention. It will be apparent, however, to one skilled in the pertinent art, that the invention may be practiced without these specific details. In other instances, well known features have not been described in detail so as not to obscure the invention. The claims following this description are what define the metes and bounds of the invention.

The following detailed description is frequently concerned with oil wells; the invention however is intended to be adapted for other types of wells to extracting other types of natural resources such as natural gas and water from geological formations.

Figure 1:
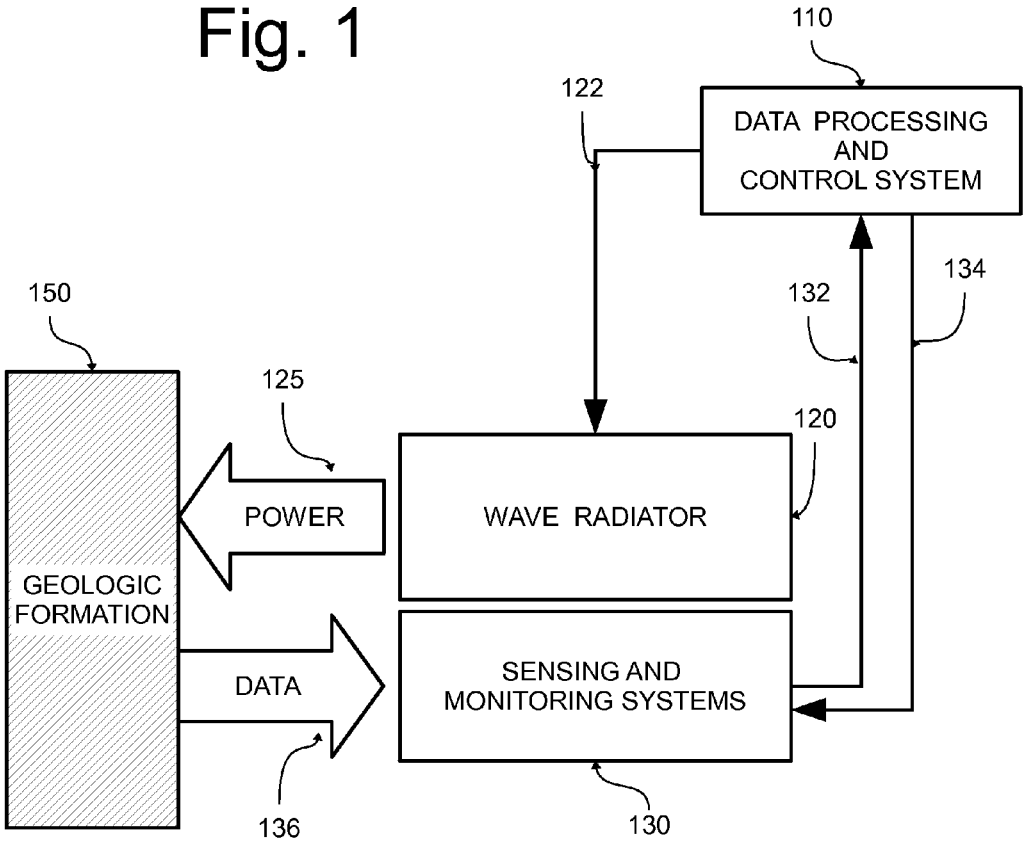
FIG. 1 is a block diagram that represents components of a system utilized to increase well production in accordance with one embodiment of the invention.

FIG. 1 is a block diagram that represents components of a system utilized to increase well production in accordance with one embodiment of the invention. A system embodying the invention comprises a wave radiator 120. The wave radiator is a device capable of delivering vibrational power 125 to a geological formation 150 such as an oil or gas containing reservoir. In embodiments of the invention, the wave radiator 120 is capable of delivering power in a wide range of power and frequency, the level of which is determined by a user (e.g., an oil/gas field manager) and/or a control system 110.

In embodiments of the invention, the wave radiator may deliver acoustic waves, mechanical waves, electromagnetic waves or any type of physical phenomenon capable of delivering vibrational energy to a geological formation.

The system embodying the invention comprises a subsystem 130 for collecting data 136 from the operating area, including the geological formation. The data collection/monitoring system 130 comprises one or more sensors for collecting a plurality of environmental data. For example, the sensors may collect temperature, pressure, viscosity, conductivity or any other physical parameter that may indicate one or more characteristics of a well. The data once collected may be transmitted, through data transmission means (e.g., copper cables, fiber optics or any other available data transmission means) 132 to a processing and control system 110.

The data processing and control system comprises one or more data processing devices, including digital computers, data visualization machines and power control units. The data processing and control system also allows a user to monitor operations and provide manual input for adjustment. The data processing and control system may execute one or more computer programs for analyzing data and one or more computer programs to provide optimization solutions to maximize the system's efficiency.

The output 122 of the data processing and control system 110 may be utilized to drive the wave radiator 120, by providing for example, instructions to the wave radiator 120, which instructions will be used by the wave radiator 120 to vary the power output 125 to the geological formation 150 in order to achieve the best results in terms of productivity. The data processing and control unit 110 may on the other hand control the power directly fed into the wave radiator 120 in order to control the amount of power delivered to the reservoir.

The data processing and control system 110 may also feed data back to the sensing and monitoring system (e.g., 134) in order to better control the data collection process.

Figure 2:
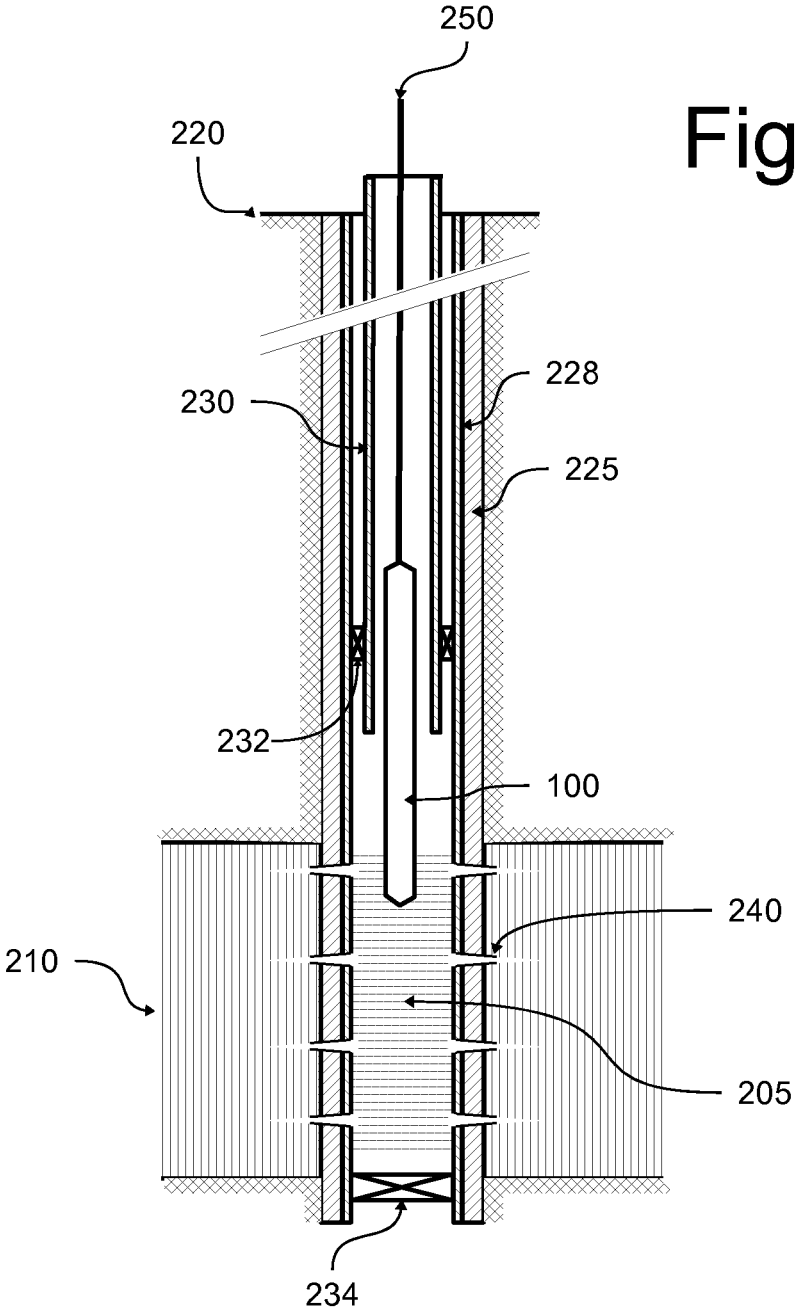
FIG. 2 shows a schematic representation of a typical well for extracting oil and/or gas, aiming at presenting the context in which an embodiment of the invention is utilized.

FIG. 2 shows a schematic representation of a typical well for extracting oil and/or gas, aiming at presenting the context in which an embodiment of the invention is utilized. Well 220, for extracting fluids from a geological formation, comprises a hole drilled in the ground. The inner side of the hole then lined with a cement layer 225 and a casing 228 that houses and supports a production tube string 230 coaxially installed in its interior. Perforations 240, in the well lining, provide a path or trajectory that allow fluids produced in the reservoir 210 to flow from the reservoir 210 toward the collection area of the well.

Typically, there are numerous perforations (e.g., 240) that extend radially from the lined or coated well. Perforations are generally uniformly separated in the lining, and pass to the outside of the lining through the formation. In an ideal case, perforations are only located within the formation, and their number depends on the formation thickness. It is rather common to have nine (9), and up to twelve (12) perforations per depth meter of formation. Other perforations extend longitudinally, and yet other perforations may extend radially from a 0°-azimuth, while additional perforations, located every 90° may define four sets of perforations around azimuth. Formation fluids pass through these perforations and pass into the lined (or coated) well.

Preferably, the oil well is plugged by a sealing mechanism, such as a shutter element (e.g., 232), and/or with a bridge-type plug, located below the level of perforations (e.g., 234). The shutter element 232 may be connected to a production tube, and defines a compartment 205. The production fluid, coming from the formation or reservoir, enters the compartment and fills the compartment until it reaches a fluid level. Accumulated oil, for example, flows from the formation and can be accompanied by variable quantities of natural gas. Hence, the lined compartment 205 may contain oil, some water, natural gas, and solid residues, with normally, sand settling at the bottom of the compartment.

A tool 100 for stimulating the well in accordance with embodiments of the invention, may be lowered into the well to reach the level of the formation. The tool may be connected to the ground surface through an attachment means 250 or simply attached to the extremity of the tube 230 using an adapter (see below), or even between two portions of the tube 230 (e.g. when the well has more than one extraction zone, more than one tool may be lowered). Thus, a tool 100 may be lowered momentarily into a well for well treatment, or alternatively by attaching the tool between two portions of the tube 230 or to the end of the tube 230, the tool may be operated even as the production continues from the well. The attachment means comprises a set of cables for providing the mechanical strength for holding the weight of tool 100. The attachment means may also comprise power cables for transmitting electrical energy to the tool, and communication cables such as copper wires and/or fiber optics for providing a means of transmitting data between control computers on the ground and the tool.

Figure 3:
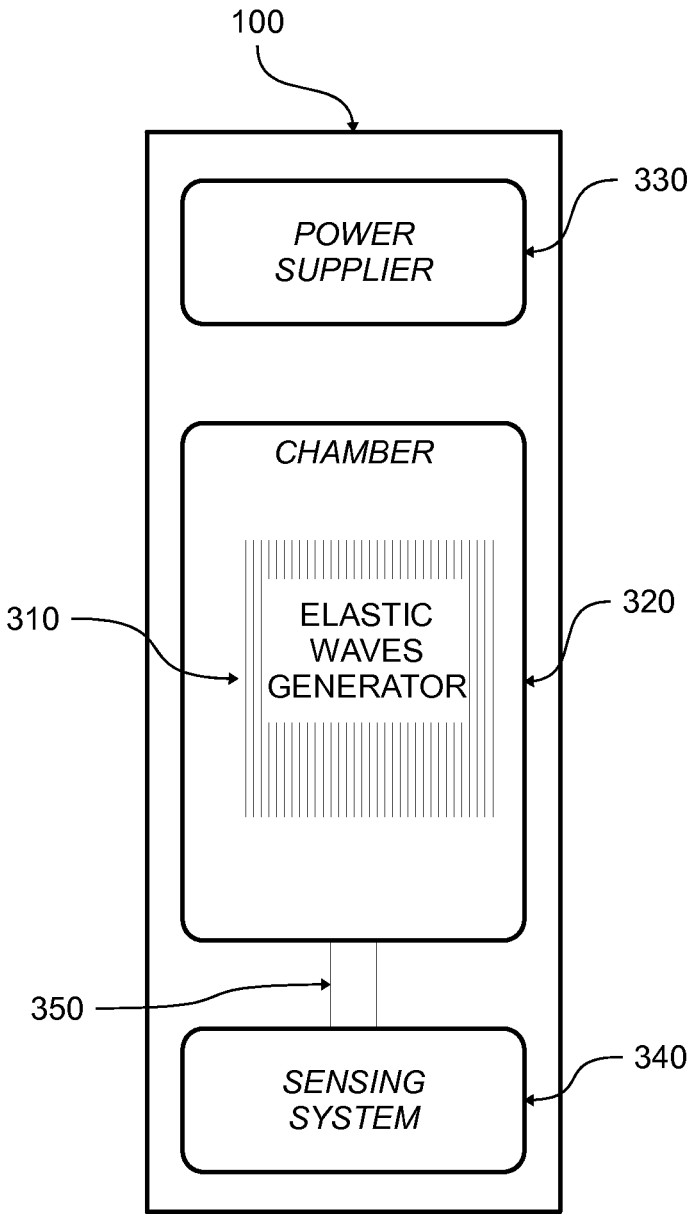
FIG. 3 is a block diagram representing components of a well stimulation device in accordance with embodiments of the invention.

FIG. 3 is a block diagram representing components of a well stimulation device in accordance with embodiments of the invention. Device 100 comprises one or more elastic waves radiating means 310. The elastic waves radiating means may be any device capable of generating vibration power, which is transmitted to the geologic formation in order to facilitate the movement of the natural resource toward the well for collection. Device 100, in accordance with an embodiment of the invention, comprises one or more chambers (e.g., 320) for hosting the wave radiators, power supply units, sensing equipment and any other component of the device.

Chamber 320 provides an important role for implementing embodiments of the invention. Chamber 320 provides an environment in which temperature, pressure and other physical parameters may be controlled in order to provide an adequate environment for an efficient functioning of device 100. For example, chamber 320 may be filled with a liquid that acts as a heat sink in order to protect equipment from the heat generated during operation. Chamber 320 may be designed with specific resonance properties to optimize the efficiency of the vibrations. Chamber 320 may be sealed to allow for high pressure inside the chamber in order to counteract the cavitation phenomena that may accompany application of sound waves to the liquid filling the chamber.

Device 100 comprises a power supply unit 330. The power supply unit comprises electronic circuitry, such as one or more circuit boards for converting power (Alternating and/or direct power) into one or more regimes of power as required by any specific type of wave radiation means comprised in the device 100. Power supply unit 330 also comprises energy storing components (e.g., one or more capacitors) capable of storing electric power and delivering the power, either automatically and/or under the control of an electronic signal.

Device 100 comprises a sensing system 340 which includes one or more sensors capable of detecting physical parameters in the well and collecting data that can be transmitted to and processed by data processing centers. The sensors may be hosted within a chamber that may be part of other chambers of device 100. Alternatively, the sensors may be hosted in a chamber that is connected with other chambers through an opening 250. The latter may be useful for allowing the liquid acting as a heat sink to freely flow and protect the sensors.

Device 100 comprises a sensing system 340 which includes one or more sensors capable of detecting physical parameters in the well and collecting data that can be transmitted to and processed by data processing centers. The sensors may be hosted within a chamber that may be part of other chambers of device 100. Alternatively, the sensors may be hosted in a chamber that is connected with other chambers through an opening 250. The latter may be useful for allowing the liquid acting as a heat sink to freely flow (e.g., 350) and protect the sensors.

Figure 4:
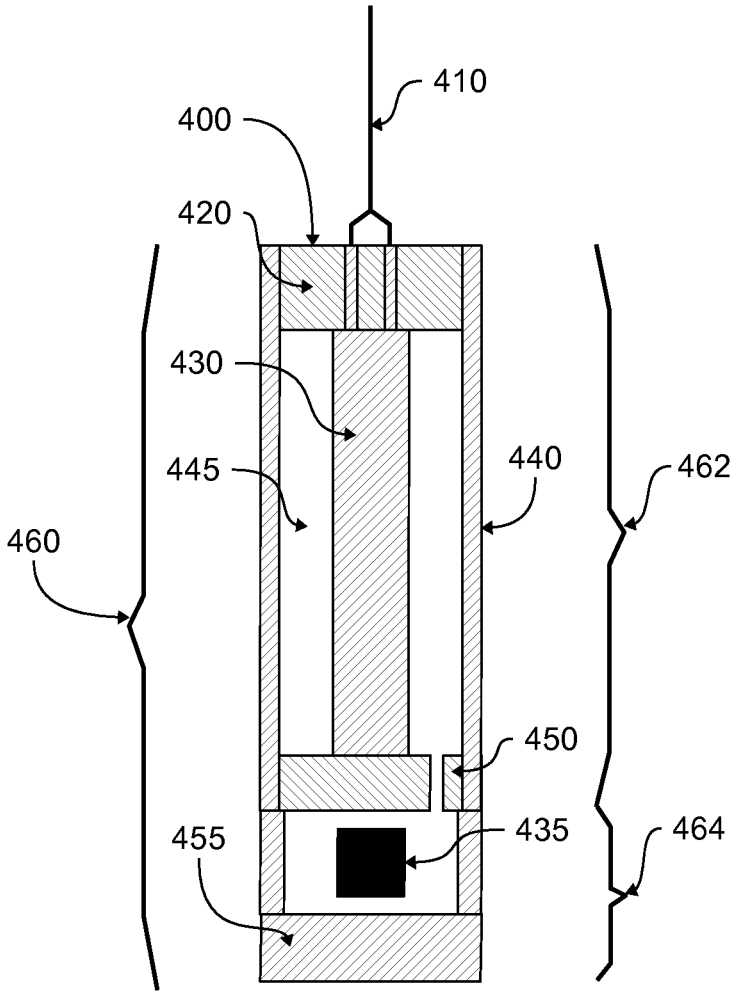
FIG. 4 represents a longitudinal section view through a device for stimulating wells in accordance with an embodiment of the invention.

FIG. 4 represents a longitudinal section view through a device for stimulating wells in accordance with an embodiment of the invention. The device 400 is one example of an implementation of the device and system as provided by the invention. Device 400 comprises a chamber 460. The chamber 460 preferably having a cylindrical shape, possesses anticorrosive properties and provides a heatsink. Device 400 may be lowered inside the well using a cable 410. The cable 410 comprises one or more electrical conductors, and is strong enough to support its own weight and the weight of device 400.

The chamber 460 may be made of a corrosion-resistant material, elastic enough for resisting mechanical vibrations. Chamber 460 comprises two (2) sections: a protective chamber 462 and a controlled-environment chamber 464. The protective chamber 462 comprises an upper cover 420, a lower cover 455, a separator 450, and a chamber wall 440. The controlled-environment chamber 464 houses measurement and control sensors 435, and is resistant to mechanical waves produced by the wave radiator.

Device 400 comprises a wave radiator 430. The wave radiator may have any form, and may be fabricated using materials that conducive to producing vibration waves such one or more magnetostrictive transducers. The invention allows for implementing transducer of several types and shapes depending of the target application, which in turn depends on the conditions in each formation.

In the example of FIG. 4, the wave radiator 430 is powered by wires 410, adequately connected through the upper seal 420. The radiator may be in other instances powered by a local power supply unit comprised within device 400.

The upper cover 420 and the separator 450 may be made of corrosion-resistant materials, and are specially designed to support the high pressure present in perforated zone of the well 210. The controlled deformation chamber is flooded with an insulator heat-sink liquid 445. This heat-sink liquid 445 surrounds the wave radiator 430. Said liquid 445 has a cooling function, allowing dissipation of heat generated by the acoustic wave radiator, and efficiently transferring said heat to the surroundings. The corrosion-resistant heat-sink chamber 460 is pressurized to prevent cavitation phenomena that may be generated through the application of sound waves. The value of internal pressure in the corrosion-resistant heat-sink chamber is adjusted depending on individual characteristics of formation and of the power level used.

The controlled environment chamber 464 may be fabricated of a material resistant to mechanical waves generated by the wave radiators 430. Inside the controlled environment chamber are measurement and control sensors 435. The main objective of this controlled environment chamber is to protect said sensors from corrosion and degradation due to hydrocarbons present in the formation, and from the waves produced by the one or more wave radiators 430.

Chamber 460 may be compartmentalized into two or more sub-chambers (e.g., 462 and 464) and the sub-chambers may be interconnected to allow free passage of the heat-sink liquid.

The purpose of measurement and control sensors 435 is to acquire information about temperature in the internal space of the chambers, reservoir pressure, and structural integrity of the chamber wall 440. This information is used to affect an automatic and/or manual control of the acoustic device 400, to optimize hydrocarbon extraction from the formation, or to detect operation failures of the device.

In embodiments of the invention, magnetostrictive transducers may be used. Such transducers need to be coiled by a special kind of wire. The wire must resist high electric currents (which in some cases may rise over 200 Amperes), and high temperatures (over 200° C.) and corrosion. Teflon insulated wires could be used to surpass the corrosion and high temperature issues. To resist high electric currents the cable's gauge should be determined to fit the specific requirements of the application (e.g. to resist currents up to 41 Amperes, a AWG #12 cable is advised).

In other embodiments, where the magnetostrictive transducers are protected from corrosion and from high temperatures, the cable's insulation could be modified in order to diminish the volume occupied by the coil, e.g., enameled wire could be used instead of Teflon.

Figure 5:
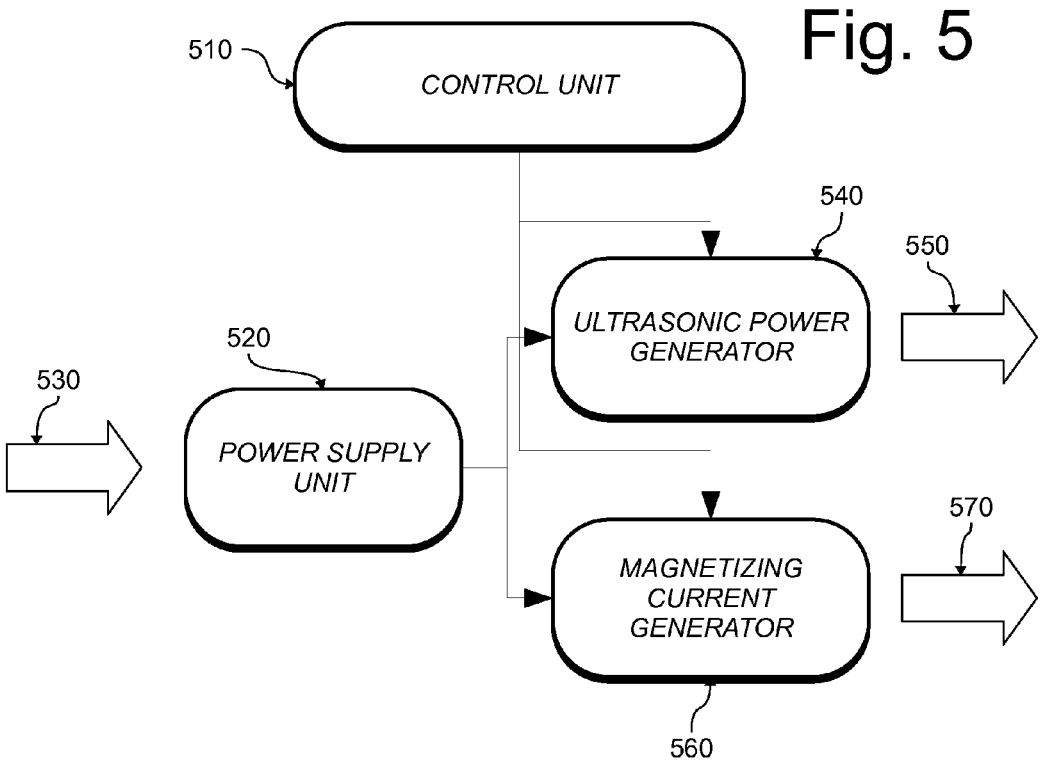
FIG. 5 is a block diagram representing components of a high-power generator for powering one or more magnetostrictive transducers in accordance with one embodiment of the invention.

FIG. 5 is a block diagram representing components of a high-power generator for powering one or more magnetostrictive transducers in accordance with one embodiment of the invention. An implementation of the invention may use one or more magnetostrictive transducers as ultrasonic radiators.

Block 510 represents a control unit, that provide a user and/or system to select the power level and regime (e.g., operating frequencies) to drive the magnetostrictive devices. Block 520 represents a power supply unit that receives power 530 input (e.g., from a tri-phasic power line having three lines of 380 Volts). Block 540 represents a component for generating power for an ultrasonic power generator. Its output (e.g., 550) may for example be a 520 Volts at 23,000 KHz. Block 560 represent the power generator for a magnetizing current. The output current (e.g. 570) may be for example a 10 Amperes current.

The power generator, as represented in FIG. 5, may produce high power ultrasonic signals that travel trough a submersible cable to the radiator placed in the wellbottom, wellbore region or perforated zone of the well.

Figure 6A:
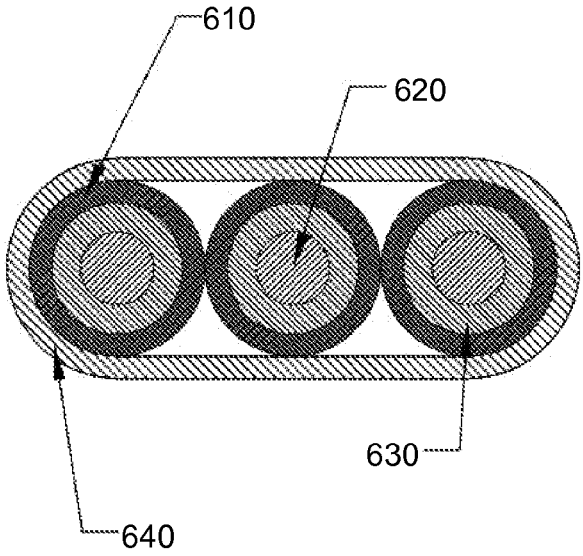
FIG. 6A and FIG. 6B show a cross section view and a perspective section view, respectively, of a submersible cable as used in one embodiment of the invention.
Figure 6B:
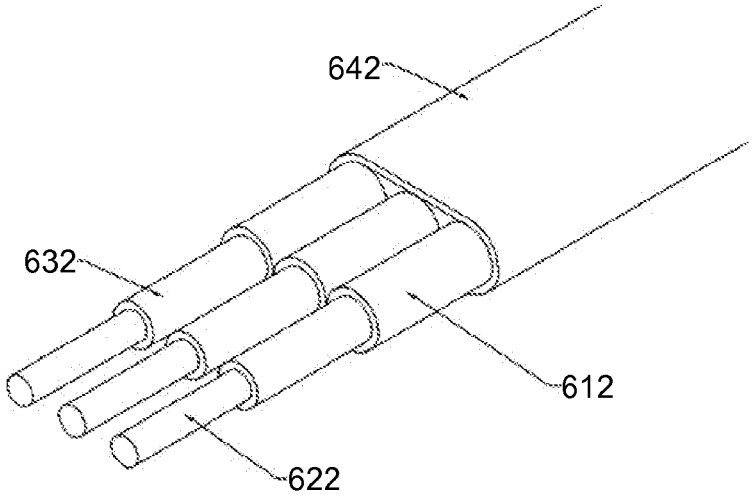

FIGS. 6A and 6B show a cross section view and a perspective section view, respectively, of a submersible cable as used in one embodiment of the invention. Embodiments of the invention may use a submersible cable to carry high power signals produced by a generator to one or more magnetostrictive transducers placed inside the well, e.g., when the generator is installed on the ground surface. Such submersible cable should have minimal energy losses. The submersible cables of FIGS. 6A and 6B comprise a plurality of conducting cables, each of which having a conductor core (e.g., 620 and 622), a dielectric (e.g., 630 and 632) and a lead (e.g., 610 and 612). The conducting cables may be surrounded, for strength, by an iron cover (e.g., 640 and 642).

Acoustic waves may be generated by means of a transducer (e.g., 310). This transducer may utilize a piezoelectric or magnetostrictive, or any other means capable of generating elastic waves. In one embodiment of the invention, the device 400 utilizes a magnetostrictive transducer. It is preferred that the material of the transducer was not only magnetostrictive, but also soft magnetic. A magnetostrictive material is one that undergoes physical change in shape and size when subjected to a magnetic field. On the other hand, soft magnetic materials become magnetic in the presence of an electric field, but retain little or no magnetism after the field is removed. Many well known alloys have these characteristics, being suitable for this application, for example nickel-iron or cobalt-iron alloys. An iron-cobalt-vanadium alloy was used in embodiments of the invention, such aloys are available for example under the commercial names of Permendur and Supermendur. The invention may be practiced, however, with any aloys that presents the characteristics described above.

To avoid losses due to eddy currents, it is preferred to form each transducer with a stack of plates of the magnetostrictive material with a layer of a dielectric material in between each plate. The plates need to be thin enough to avoid eddy currents but sufficiently thick to have a magnetostrictive effect that would successfully produce the required acoustic waves. According to the invention, plates may have a thickness of between 0.1 mm and 4 mm. In one embodiment of the invention, the plates have a thickness of 0.15 mm thickness.

The magnetostrictive principle works with a plurality of geometries. The device, according to one embodiment of the invention, utilizes the length of the plates as determined to be half of the wavelength of the mechanical waves in said magnetostrictive material. The latter maximizes the elastic wave generation.

Figure 7A:
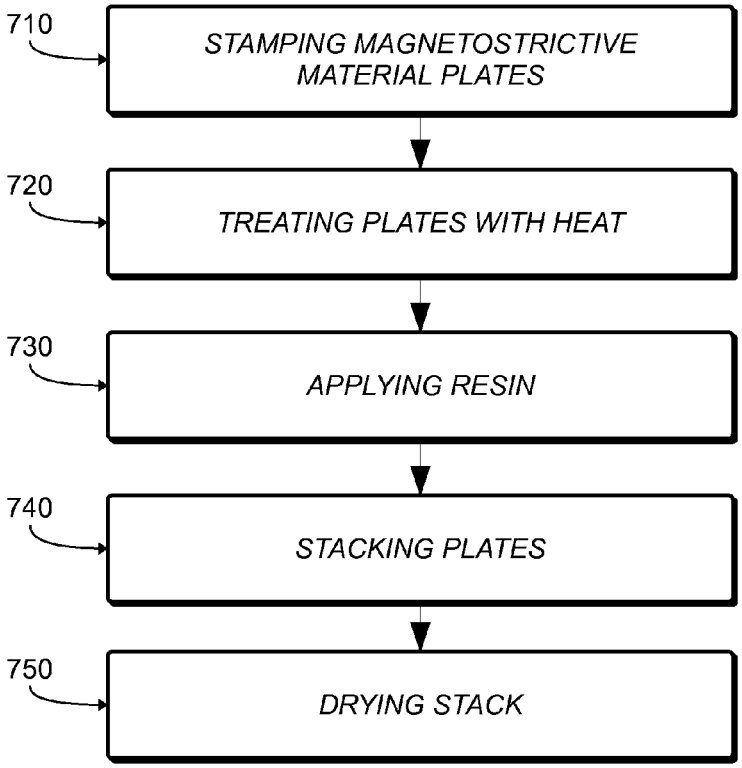
FIG. 7A is a flowchart diagram of method steps involved in fabricating elastic waves generator using magnetostrictive material in accordance with an embodiment of the invention.

FIG. 7A is a flowchart diagram of method steps involved in fabricating elastic waves generator using magnetostrictive material in accordance with an embodiment of the invention. At step 710, the material is stamped into plates. For optimal magnetic properties, an annealing heat treatment may be required, after the stamping process and before stacking. At step 720, the plates are heat treated. One of the recommended heat treatment has to be done in a dry hydrogen or argon atmosphere, or in a vacuum atmosphere, to minimize oxide contamination. The entry due point should be dryer than −51° C. and the exit due point dryer than −40° C. when the inside retort temperature is above 482° C. (See FIG. 7B).

At step 730, a resin is applied to the plates. Then, at step 740, the plates are stacked. Each transducer may have, for example, between 100 and 400 plates, and in one embodiment of the invention a transducer may utilize between 250 and 350 plates. To avoid losses due to undesired longitudinal waves, the transducer height (given by the number of plates) and width should be similar. The dielectric material can be for example an epoxy resin. In this case, the resin under the trade name Sintepox LE 828 was used. The thickness of the dielectric layer can be between 0.01 mm and 0.05 mm, and a 0.025 mm thickness was used in the present device. The application of the resin can be done in several ways. For example, the resin may be manually applied using a brush, soaking the plates in the resin, with an aerosol or with any other available means for applying resin.

The stacking of the plates can be done manually or automatically. After applying the resin the plates are stacked applying pressure to eliminate resin excess and control the dielectric layer thickness. At step 750, the plates are dried using an optimal curing temperature according to the resin data sheet.

Figure 7B:
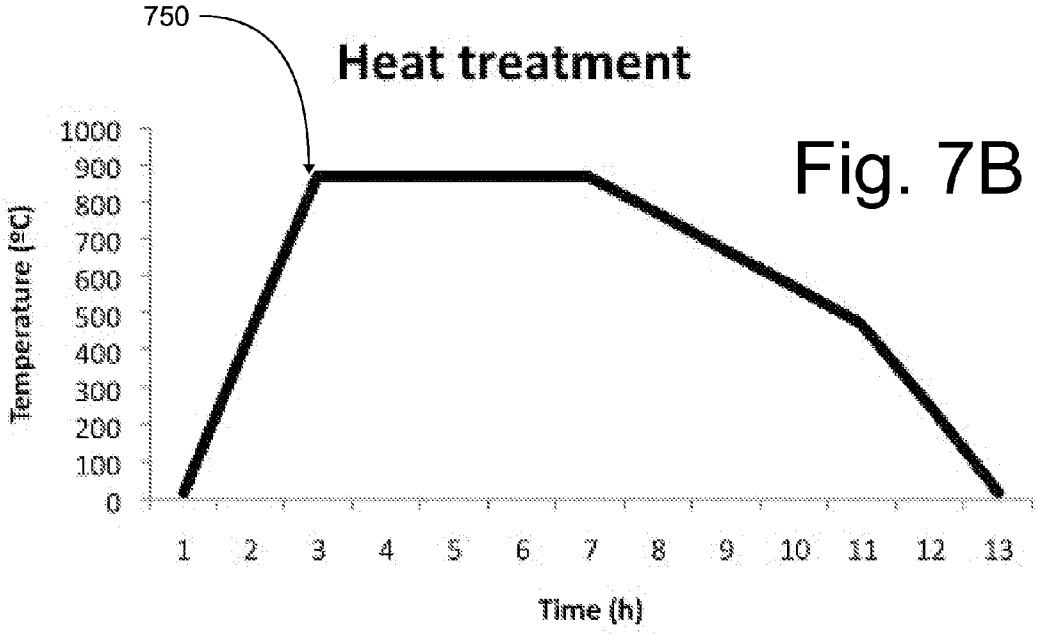
FIG. 7B is a plot of the temperature for curing resin versus time of curing in accordance with embodiments of the invention.

FIG. 7B is a plot of the temperature for curing resin versus time of curing in accordance with embodiments of the invention. Cure 750 generally shows that curing is applied between 1 and 13 hours with a temperature of 0 to around 900° C.

During operation, a wave generator in accordance to the invention produces mechanical vibrations. The mechanical vibrations promote formation of shearing vibration in an extraction zone, due to phase displacement of mechanical vibrations produced along one axis of the well, thus achieving alternating tension and pressure forces due to superposition of longitudinal shear waves, and so stimulating the mass transfer processes within the well.

Figures 8A, 8B, 8C:
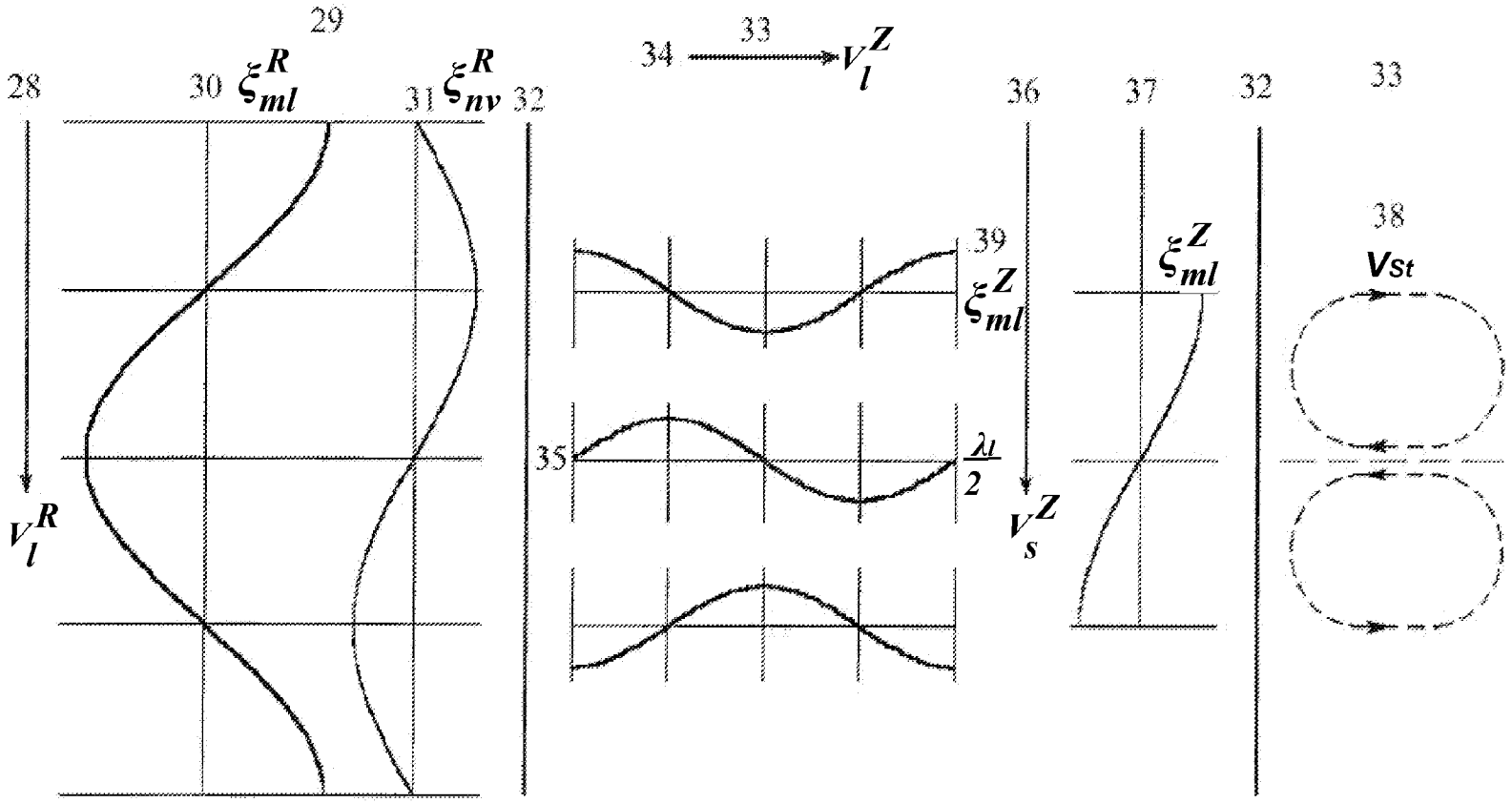
FIGS. 8A, 8B and 8C show a set of plots that represent vibrational energy transfer along the longitudinal and radial axes between a device implementing the invention and the surrounding area in the operation zone.

FIGS. 8A, 8B and 8C show a set of plots that represent vibrational energy transfer along the longitudinal and radial axes between a device implementing the invention and the surrounding area in the operation zone. FIG. 8A represents a longitudinal vibration. The oscillating velocity vector VR1 (28) from longitudinal vibrations, propagated within the chamber of the device (e.g., 460) is directed along the axis of said chamber. Simultaneously, the amplitude distribution of vibratory displacements $\xi^R_{ml}$(30) of longitudinal vibrations is also propagated along the chamber. In place of the above, and as a result of Poisson effect, radial vibrations are generated in the chamber, which has a characteristic distance, and an amplitude of displacement $\xi^R_{nv}$ (31).

FIG. 8B represents radial vibrations. Radial vibrations through the radiant surface (32) of either the elastic wave radiator (32) or the chamber are transmitted to the inside of the reservoir (33) surrounding the well. Velocity vector $V^z_1$ (34) of longitudinal vibrations is propagated to the reservoir (33) surrounding the well in a direction perpendicular to the longitudinal axis of the chamber. Diagram 35 shows the radial distribution characteristic of displacement amplitudes $\xi^z_{ml}$ (39) of radial vibrations propagated to the reservoir (33) surrounding the well; they are radiated from points of the chamber that may be located at a distance equal to $\lambda/2$, $\lambda$ being the wavelength of longitudinal waves in the material of resonance chamber.

FIG. 8C represents phase displacement. Phase displacement of radial vibrations propagating in the medium generates shearing vibrations in a perforated region of the well, whose oscillating velocity vector $V_{ZS}$ (36) is directed along the axis of the chamber. Diagram 37 shows the characteristic distribution of displacement amplitudes of shearing vibrations $\xi^Z_{mS}$.

As a result of the superposition of longitudinal and shearing waves, an acoustic flow (jet streaming 38) is produced in the perforated region of the well (e.g., 210), improving the desired effect of viscosity reduction and mass transfer.

Figure 9:
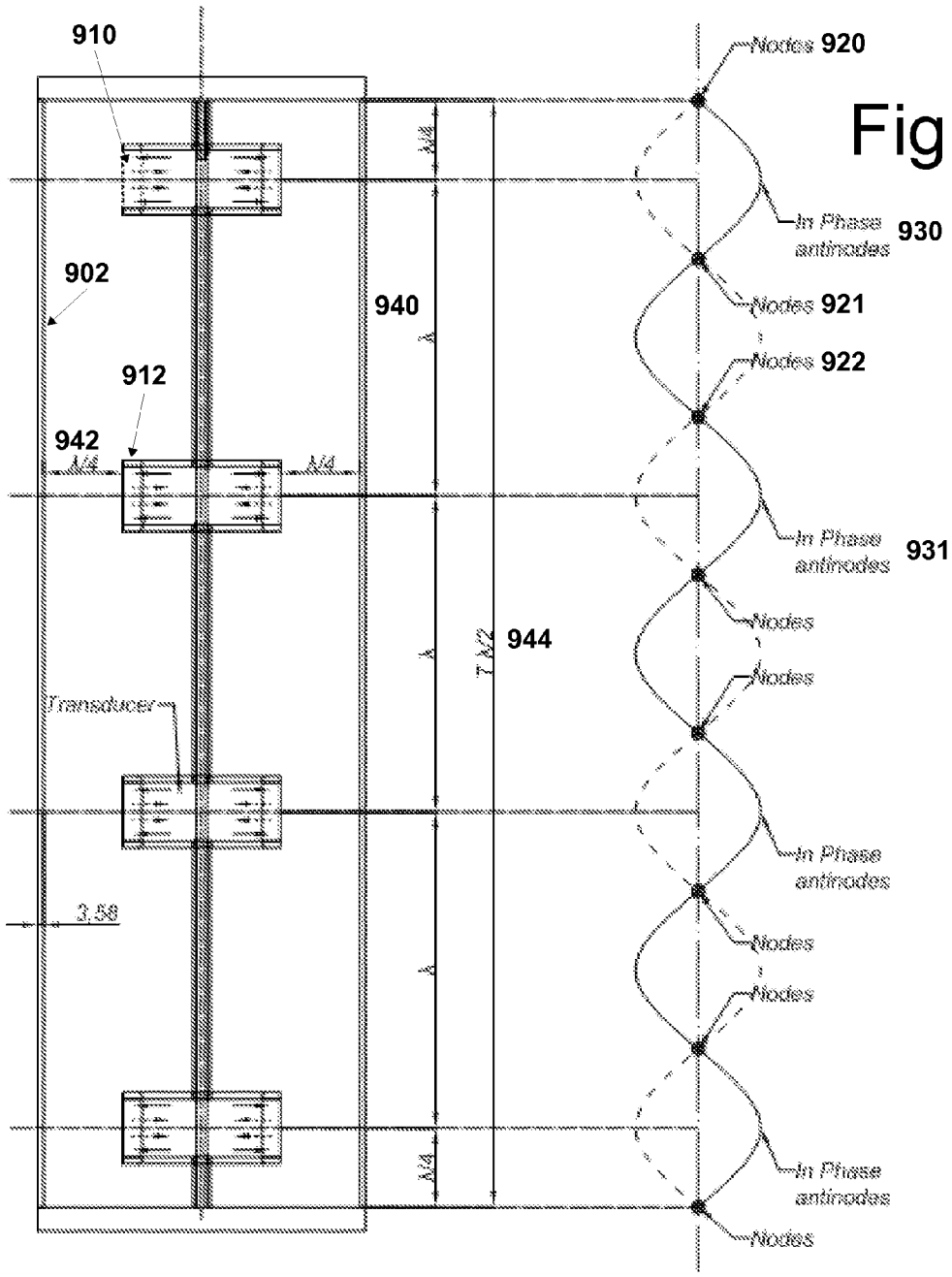
FIG. 9 illustrates the geometry of a device implementing the invention where the layout of transducers in relation with wave propagation properties is used to optimize the amount of vibration energy transferred to the surrounding operation zone.

FIG. 9 illustrates the geometry of a device implementing the invention where the layout of transducers in relation with wave propagation properties is used to optimize the amount of vibration energy transferred to the surrounding operation zone. FIG. 9 illustrates an implementation where one or more transducers (e.g. 910 and 912) are mounted within the chamber of the device, thus allowing the transducers to be submerged in the heat-dissipating liquid. In the latter configuration, the radiation of elastic waves is carried out by the wall of the chamber 902. Therefore, the geometry of the each of the component of the device and their respective specific resonance frequencies are taken into account when implementing the invention. For example, while waves are propagating through the device from one or more transducers, oscillating waves of similar frequencies cancel each other in some regions (e.g. nodes 920, 921 and 822), and superimpose in other regions (e.g., anti-nodes 930 and 931). The distance of the transducers (e.g., 910 and 912) with respect to each other (e.g., 940) and with respect to the wall of the chamber (e.g. 942) and with respect to the wave-length of the elastic wave (e.g. 944) may be critical to the resonance to the device implementing the invention. Therefore, the invention provides a method for laying out the one or more transducers with the device in order to optimally apply the vibration energy to the operation zone.

For example, a radiant surface 902 having a tubular geometric shape, with an external diameter $D_o$, and geometric dimensions of radiant surface, length "L" and wall thickness "λ" may be determined by working conditions under resonance parameters of radial and longitudinal vibrations, at natural resonance frequency of the wave radiator. To implement the principle above indicated, regarding formation of a superposition of longitudinal- and shear waves in the perforated region of the well, the length "L" of the chamber should be at least half of the longitudinal wavelength λ the acoustic wave inside the material of the radiant surface; that is, $L \leq \lambda/2$, e.g., in an oil well with a chamber made of stainless steel, the sound velocity in such stainless steel at 100 atm pressure is approximately 6000 m/s, and the radiator operating at a 25 KHz frequency, the wavelength is 24 cm, thus the length 'L' must be at least 12 cm long.

Figure 10:
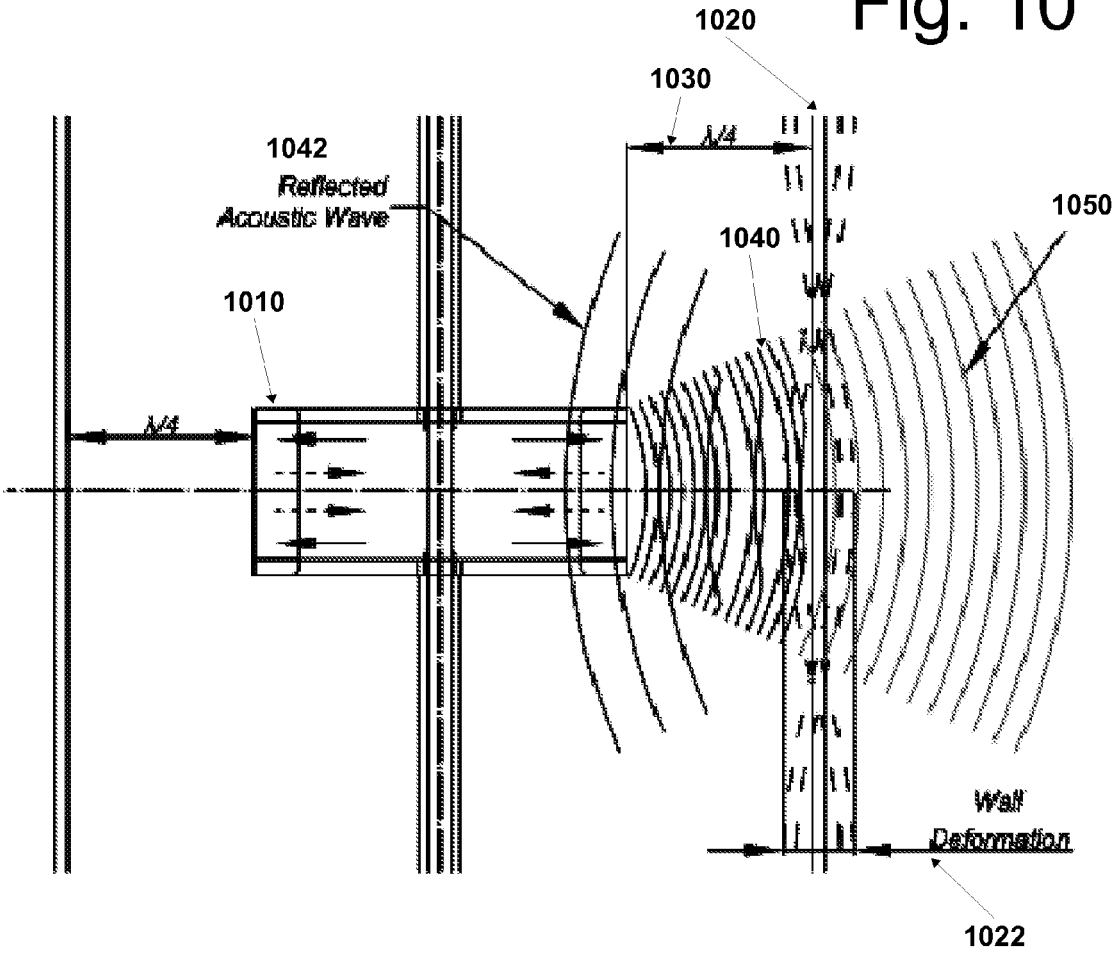
FIG. 10 illustrates the interaction between the transducer and the wall of the chamber when geometry is adequately configured to utilize the resonance properties of the device implementing the invention.

FIG. 10 illustrates the interaction between the transducer and the wall of the chamber when geometry is adequately configured to utilize the resonance properties of the device implementing the invention. A wave generating source 1010 may be situated within a quarter if the wave length 1030 (λ/4) from the chamber wall 1020. An incident wave 1040 emitted by the wave generating source 1010 causes the wall 1020 to vibrate within a given deformation distance 1022. The vibration of the wall, in turn, becomes a powerful source of a sound wave 1050. In addition, the incident wave cause a reflected acoustic wave 1042. The reflected acoustic waves, although will be attenuated as they travel in the liquid filling the chamber, contribute to the amplification of the vibrations in accordance with the resonance properties of the device. The radiation of power as elastic waves to the extraction zone in the geologic formation is thus carried without bringing the wave generator in contact with the geologic formation. The acoustic waves generated by the wave generator are transmitted through the liquid to the chamber wall which has a geometry that is critical to transmitting (and eventually) amplifying the acoustic waves. The adequate geometry in accordance with embodiments of the invention comprises a chamber whose length is a multiple of the wave length of the vibration.

FIGS. 11A and 11B examples of geometries for the layout of a plurality of acoustic wave sources hosted within one or more devices implementing the invention. The devices represented in 1110 and 1120 have respective device length of 1112 and 1122, which attribute to their respective device a resonance frequency. In device 1110 of FIG. 11A.1, the distance 1118 separating a pair of acoustic sources may be a multiple of the wave length, whereas in device 1120 of FIG. 11A.2, the distance 1128 separating a pair of liquid acoustic sources may be half the wave length. In either case, these embodiments of the invention result in using the resonance properties of the device to amplify and transfer the wave's energy to its surrounding.

FIG. 11B.1, 11B.2 and 11B.3 illustrate geometries of various dispositions of an acoustic wave source with regard to the wall of the chamber in accordance with one or more embodiments of the invention. As represented in FIG. 11B.1, an acoustic wave source (e.g. 1130) may be mounted in contact with the wall 1135. Wave energy is then transmitted to the wall 1135 both through direct contact and through the heat dissipating liquid 1131.

As represented in FIG. 11B.1, an acoustic wave generator, such as 1140, may be mounted so as not directly touch the wall 1145. The acoustic wave energy is then transmitted to the wall 1145 through the liquid 1141. In an other instance, as represented in FIG. 11B.1, an acoustic wave generator, such as 1150 may be connected to the wall 1155 through a wave guide 1158. The wave energy, in the latter case, is transmitted to the wall 1155 through both the liquid 1151 and the wave guide 1158.

Several dispositions of one or more wave radiators may be implemented. For example:

-in-phase wave radiators placed every integer multiples of the wavelength (n·λ), in direct contact with the chamber wall, -in-phase wave radiators placed every n·λ, without direct contact with the chamber wall, -in-phase wave radiators placed every n·λ, with a waveguide which connects said radiators with the chamber wall, −180° out-of-phase wave radiators placed every n·λ+λ/2, in direct contact with the chamber wall, −180° out-of-phase wave radiators placed every n·λ+λ/2, without direct contact with the chamber wall, −180° out-of-phase wave radiators placed every n·λ+λ/2, with a waveguide which connects said radiators with the chamber wall.

Figure 12A:
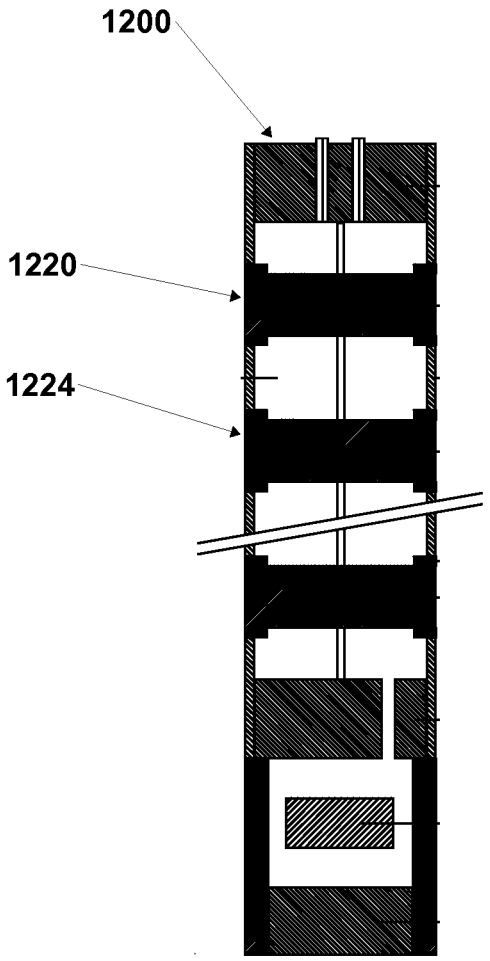
FIG. 12A and FIG. 12B represent a longitudinal and transversal section views, respectively, of a device implementing the invention where one or more acoustic waves generators are in direct contact with the wall of the radiating chamber.
Figure 12B:
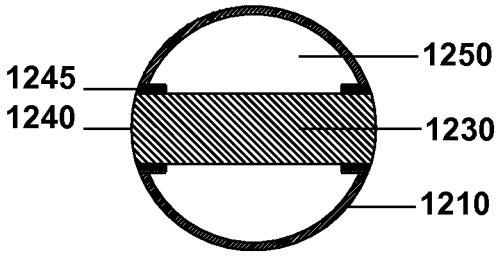

FIG. 12A and FIG. 12B represent a longitudinal and transversal section views, respectively, of a device implementing the invention where one or more acoustic waves generators are in direct contact with the wall of the radiating chamber.

In the embodiment shown in FIGS. 12A and 12B, the device implementing the invention 1200 comprises one or more acoustic wave radiators (e.g., 1220, 1224 and 1230) the radiant surface of which is in direct contact with the fluids of the formation. The acoustic radiators e.g., 1220, 1224 and 1230) emerge through orifices 1240 in the chamber wall 1210. The chamber maintains its capacities to protect the inner components of the system and provide a heat dissipating capacity, through the use of the heat dissipating liquid 1250, because the gap between the wave radiator(s) and the orifices may be completely sealed with a seal 1245. This disposition is primarily used to avoid major losses due to wave reflection and/or attenuation of the mechanical waves produced by the wave radiators (e.g., 1220, 1224 and 1230).

Figure 13:
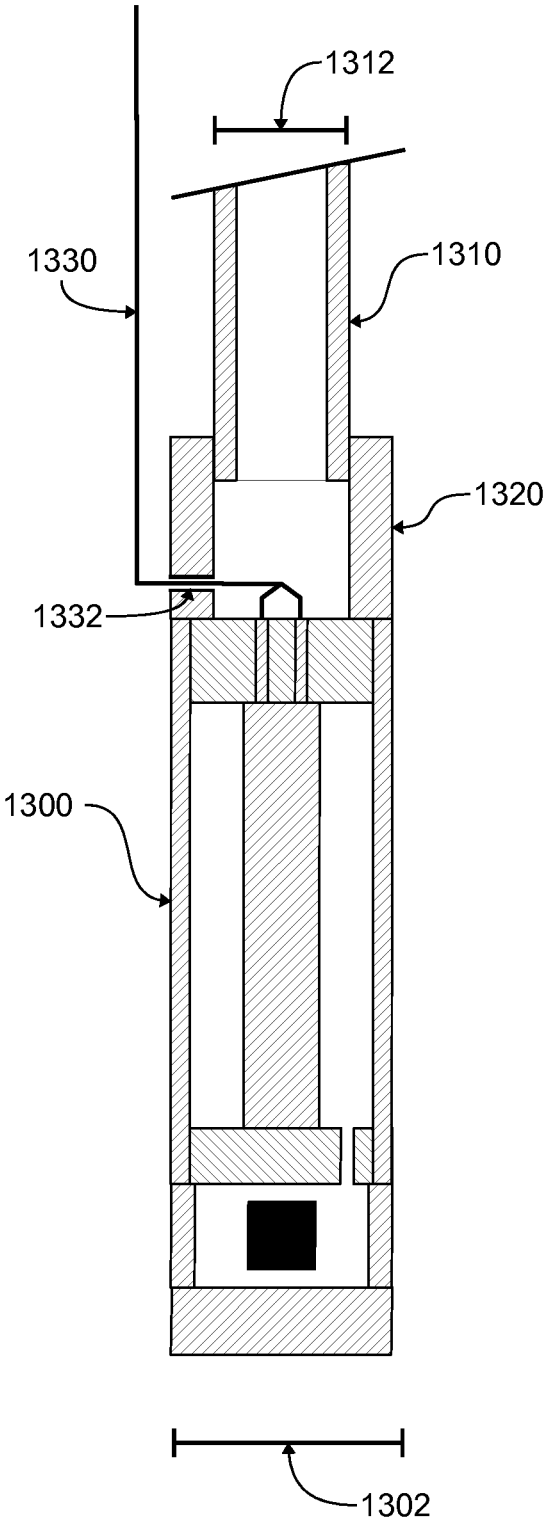
FIG. 13 shows a longitudinal section view of a device implementing the invention where the diameter of the device exceeds that of the tubing in a well, and the means to attach the device to the tubing.

FIG. 13 shows a longitudinal section view of a device implementing the invention where the diameter of the device exceeds that of the tubing in a well, and the means to attach the device to the tubing. Device 1300 has a diameter 1302 larger than the diameter 1312 of the tubing 1310, but smaller than that of the casing or external tube. In the latter particular case, the tubing 1310 must be completely withdrawn, and the elastic wave device implementing the invention must be connected in between two sections of the tubing 1320 or to the end of the tubing 1320. The cable 1330, in the latter case, must run along outside the 'tubing' 1310 and must be introduced into the device through a hole (e.g., 1332) in the adapter 1320.

Figure 14:
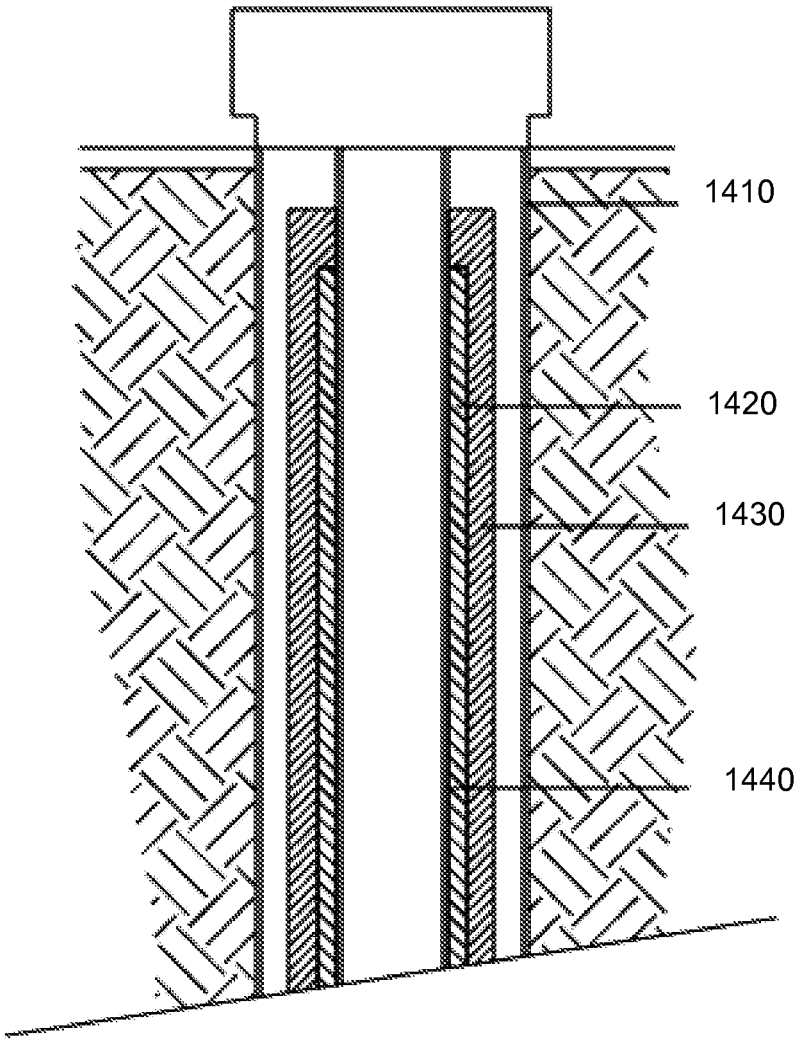
FIG. 14 a longitudinal section view illustrating several layers that allow a tubing in accordance with an embodiment of the invention to enhance the heat transfer rate to the crude in the reservoir in order to reduce viscosity of crude oil.

FIG. 14 a longitudinal section view illustrating several layers that allow a tubing in accordance with an embodiment of the invention to enhance the heat transfer rate to the crude in the reservoir in order to reduce viscosity of crude oil. To maintain the higher temperature of the crude oil and therefore reduce its viscosity, a heating device 1420 may be installed alongside the tubing 1440, which heats the tubing across the whole length of the well. E.g., the heating device 1420 may be installed in the space between the tubing and the casing 1410, being the tubing thermally isolated 1430 from the surrounding environment; and it could be powered by a generator placed in the well surface.

Figure 15:
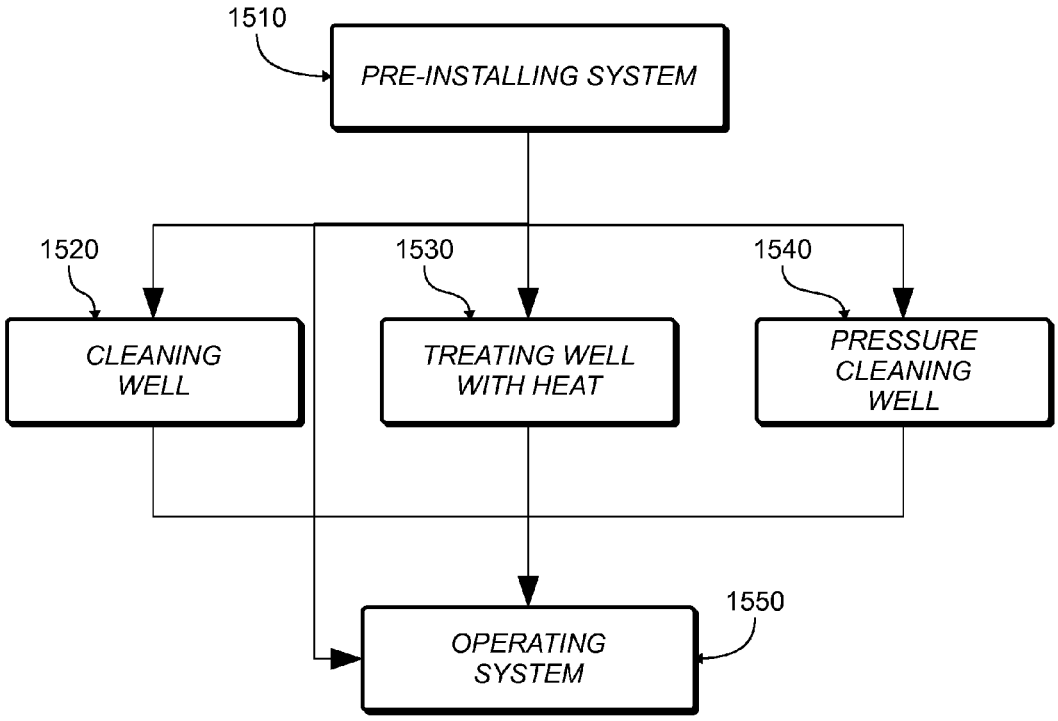
FIG. 15 is a flowchart diagram representing the overall steps comprised in deploying a system embodying the invention, applying one or more preliminary treatment, and permanently operating the system.

FIG. 15 is a flowchart diagram representing the overall steps comprised in deploying a system embodying the invention, applying one or more preliminary treatment, and permanently operating the system. Step 1510 represents several stages in the planing of the deployment, adapting the system to the type of the intended treatment, connecting the various parts of the system, and testing the functioning of the system. Step 1510 may be viewed as a pre-installation phase, since the system may be moved several times, and operation may be alternately started and stopped in order to determine an operation location, take measurements and carry out any necessary task required for the well functioning of the system at later stages.

Following the pre-installation, one or more treatments may be carried depending on the type of well, the resource to be extracted and the state of the resource to be extracted. For example, depending on the content in gas of an oil well, or the viscosity of the crude oil in the well, a determination may be made to treat the well in one or many ways before the system is permanently installed and operated.

For example steps 1520, 1530 and 1540, respectively represent stages of well cleaning, heat treatment of the well and/or cleaning a well under pressure. Once the well has undergone one or more treatments (e.g, steps 1520, 1530 and 1540), the tool can be permanently installed and operated in-situ.

Figure 16:
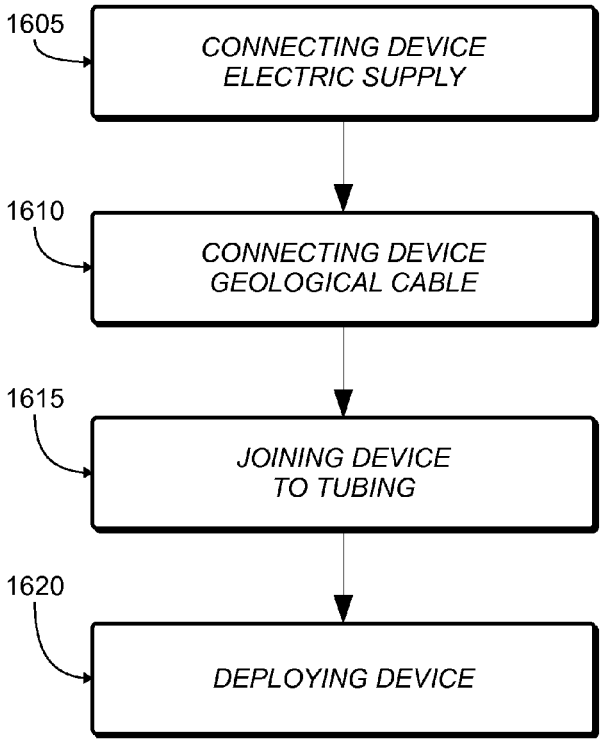
FIG. 16 is a flowchart diagram showing steps involved in deploying a device implementing the invention.

FIG. 16 is a flowchart diagram showing steps involved in deploying a device implementing the invention. At step 1605, a device implementing the invention is connected to the power supply. A series of electrical connections made on the surface that are necessary for the proper operation of the system. For example, the connection may be made through a tri-phasic power line (see above) to the ultrasonic generator, electric connection between the ultrasonic generator and the geophysical cable and electrical checking of the connections through continuity tests.

At step 1610, the device geophysical cable is connected. Connection is made between the acoustic tool and the geophysical cable. Step 1610 involves connecting the positioned tool in the wellbottom, wellbore or perforated zone of the well, to a geophysical cable of a proper length. In addition, step 1610 involves checking the electrical connections through continuity tests.

At step 1615, the device implementing the invention is joined to the tubing. The latter step involves connecting the device to the tubing, using for example, a standard couple in the oil industry.

At step 1620, a device implementing the invention is deployed. The latter step involves installing a tuning string with the acoustic tool attached to its end through a rig truck and a temporal wellhead. The latter step also comprises checking the electrical connections through continuity test.

Figure 17:
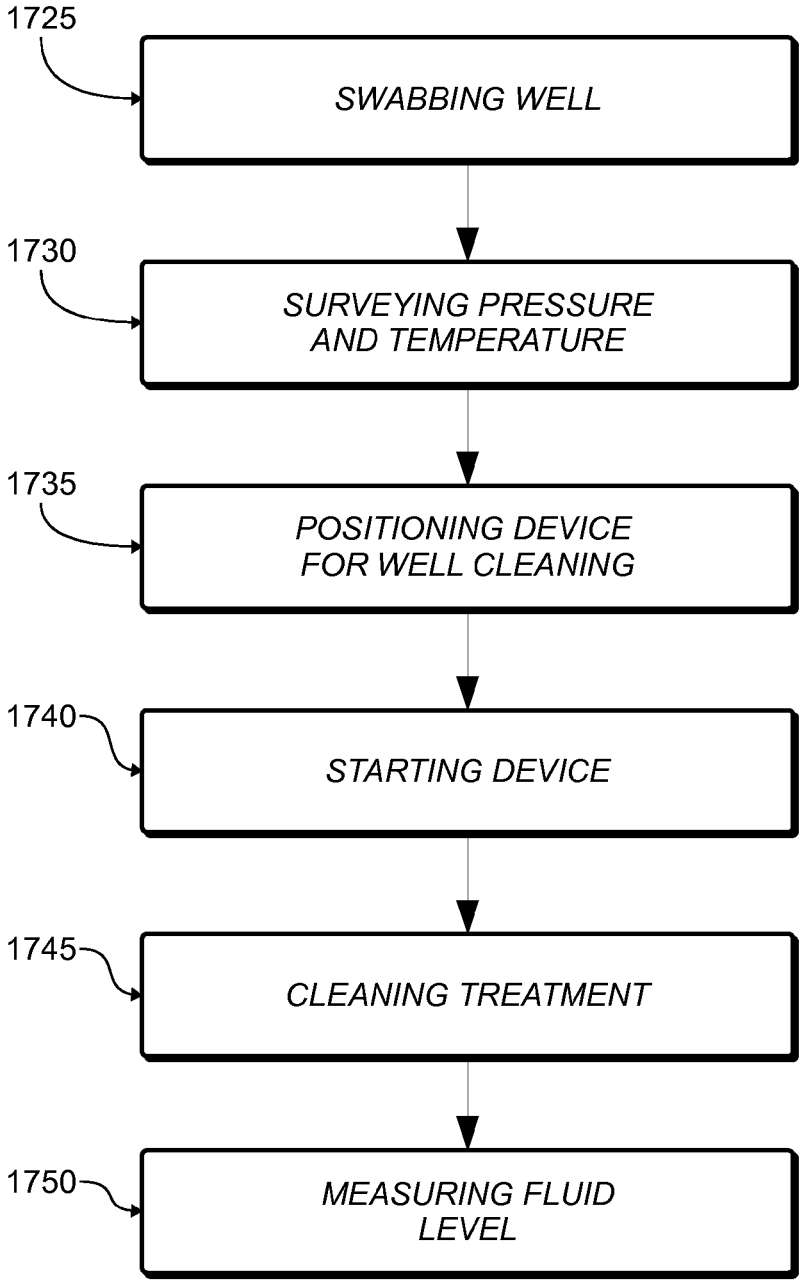
FIG. 17 is a flowchart diagram representing steps of cleaning a well before permanent operation in accordance with one embodiment of the invention.

FIG. 17 is a flowchart diagram representing steps of cleaning a well before permanent operation in accordance with one embodiment of the invention. At step 1725, a swabbing operation of an oil well, for example, may be carried out to extract the liquids inside the well through a rig truck, in order to attain a certain objective liquid level inside the oil well.

At step 1730, pressure and temperature are surveyed, among other physical variables (e.g. viscosity). The latter step involves measuring temperature and pressure profiles before the acoustic well stimulation. Further temperature and pressure measurements are conducted after the acoustic stimulation, and the profiles are compared in order to determine the changes that are the result of the acoustic treatment.

At step 1735, a device implementing the invention is temporarily positioned at a point of interest (e.g., wellbottom, wellbore or perforated zone of the well) in order to conduct well cleaning at that particular point of interest.

At step 1740, the device is started, which involves switching on the ultrasonic generator, setting up the working parameters (frequency, current and power). The latter step further involves checking the correct functioning of the system through current and voltage measurements at the output of the generator.

At step 1745, the point of interest previously selected is cleaned by temporarily operating the acoustic device in a specific depth, and its subsequent repositioning to another point of interest.

At step 1750, a measurement of fluid level is carried out of the liquid in the wellbottom, wellbore and/or the perforated, by means of adequate tools (e.g. EchoMeter). The latter measurement may be crucial in order to maintain the pressure in the wellbottom so that an efficient acoustic power transmission is achieved.

Figure 18:
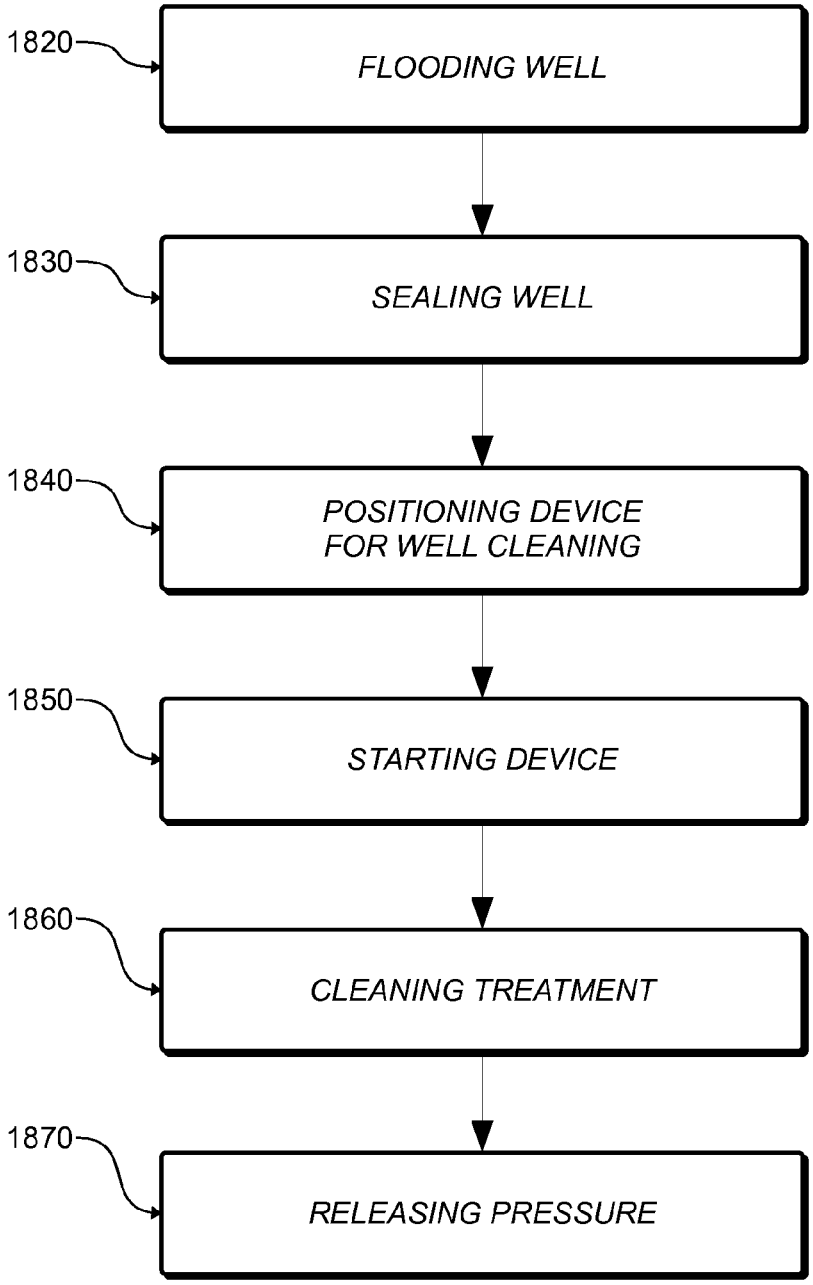
FIG. 18 is a flowchart diagram representing steps comprised in the process of cleaning a well in accordance with an embodiment of the invention.

FIG. 18 is a flowchart diagram representing steps comprised in the process of cleaning a well in accordance with an embodiment of the invention. At step 1820, a well is flooded. In the latter step, completely flooding the well to helps the acoustic power transmission to the operating zone (wellbottom, wellbore and perforated zone of the well). At step 1830, the well is sealed. Sealing the well by means of a standard retention valve prevents high pressure gas from escaping. At step 1840, a device implementing the invention is positioned in the well. The device is temporarily positioned at a point of interest (e.g. wellbottom, wellbore or perforated zone of the well). At step 1850, the device is started. At step 1850, the one or more ultrasonic generators are started, and working parameters (frequency, current and power) are setup. The latter step comprises checking the correct functioning of the system through current and voltage measurements at the output of the generator.

At step 1860, the point of interest where the device was positioned is cleaned by temporary action of the acoustic tool at a specific depth, and its subsequent repositioning to another point of interest.

At step 1870, the pressure is released following the cleaning at every depth in order to stimulate the movement of the obstructive particles and their natural decantation to the wellbottom.

Figure 19:
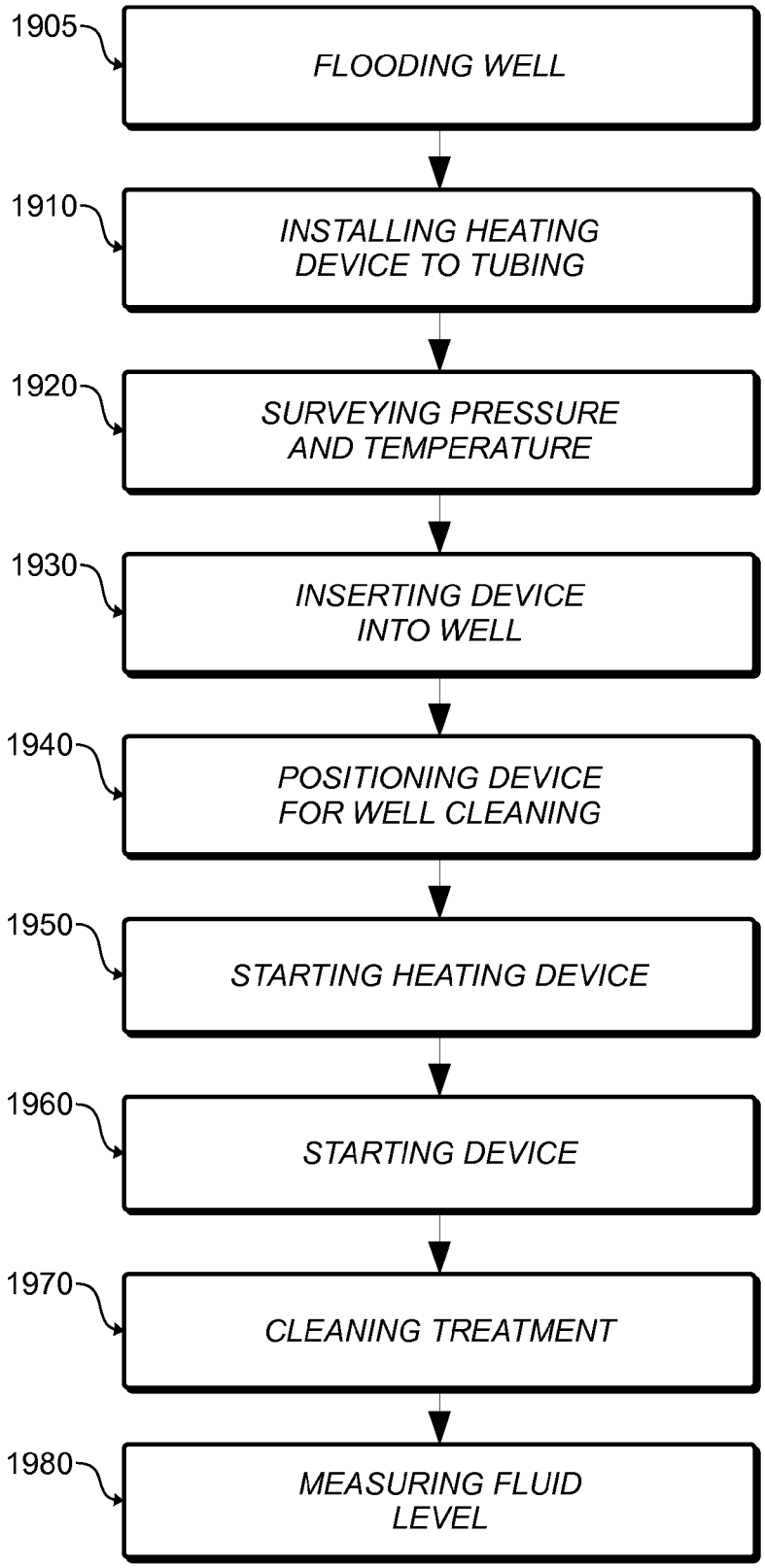
FIG. 19 is a flowchart diagram representing steps comprised in heat treatment of heavy oil in accordance with one embodiment of the invention.

FIG. 19 is a flowchart diagram representing steps comprised in heat treatment of heavy oil in accordance with one embodiment of the invention. Oil wells with a high content of paraffin may be treated using an in-situ heating system.

At step 1905, a well is flooded (similarly as described above). At step 1910, the heating device is installed along the tubing (as described in FIG. 14). At step 1930, the device implementing the invention is inserted in to the well. At step 1940, the device is positioned at a point of interest (as described above). At step 1950, the heating device is started. At step 1960, the one or more acoustic generators comprised within a stimulation device are started. At this stage, the heat cause to lower the viscosity of the oil, and the acoustic waves cause the mechanical displacement of the oil and the removal of fines.

At step 1970, the well is cleaned as described above. At step 1980, the level of fluid is measured for further adjustment of the treatment time and parameters.

Figure 20:
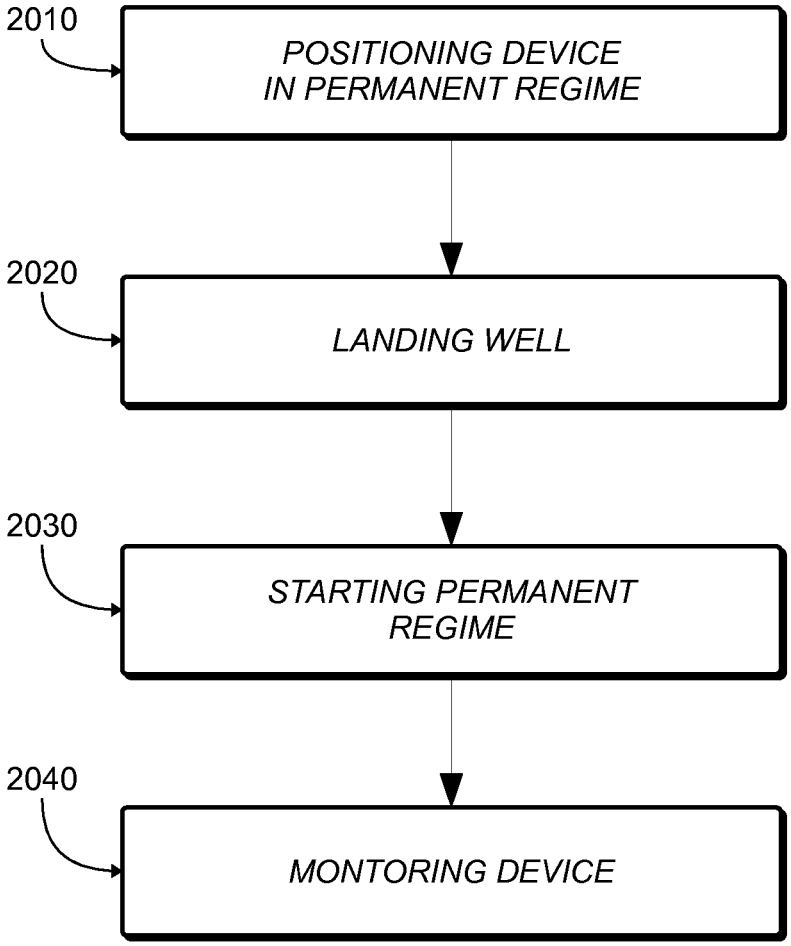
FIG. 20 is a flowchart diagram representing steps comprised in the permanent installation of a system embodying the invention.

FIG. 20 is a flowchart diagram representing steps comprised in the permanent installation of a system embodying the invention. At step 2010, a device implementing the invention is positioned at a specific operating depth for permanent operation.

At step 2020, well landing is carried out. The latter step involves installing and deploying a pumping device. This stage includes the removal of the temporal wellhead of the well, the disconnection of the geophysical cable from the generator, the connection of the geophysical cable to the permanent wellhead of the well. The well is closed and sealed At step 2030, the permanent regime is started. The latter step involves acoustically stimulating the well in a permanent regime, which may be carried out concomitantly with oil extraction.

At step 2040, the well and the device are monitored, and one or more operating parameters of the acoustic stimulation system (frequency, power and magnetizing current) may be modified to optimize the performance of the treatment.

During operation, a device for generating acoustic waves in accordance with embodiments of the invention may be operated using a continuous power signal, a pulsed signal or any other mode a user may determined appropriate for any given treatment. For example, control system 110, may deliver power to the wave generator in wide range of power and frequency, where the level may be determined by the user and/or a control system 110.

In embodiments of the invention, the data processing and control system (e.g., 110) may be utilized to drive the wave radiator, by providing for example, instructions to the wave radiator, which instructions will be used by the wave radiator to vary the power output to the geological formation in order to achieve the best results. The data processing and control unit may on the other hand control the power directly fed into the wave radiator in order to control the amount of power delivered to the reservoir.

In embodiments of the invention, the wave radiator may be deliver acoustic waves, mechanical waves, electromagnetic waves or any type of physical phenomenon capable of delivering vibrational energy to a geological formation.

A control system implementing the invention enables the system to irradiate the geological formation in any operating regime the user desires. Including continue, alternated, pulsed, in amplitude modulation, frequency modulation, among many other possibilities.

Figure 21A:
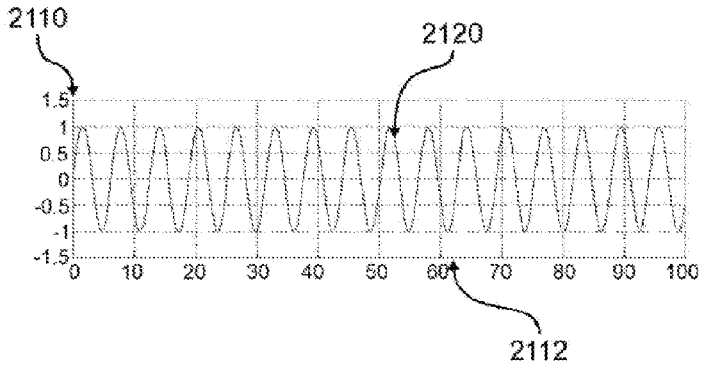
FIG. 21A is a plot of the power as a function of time of a high frequency continuous signal for driving a wave generator, in accordance with one embodiment of the invention.

FIG. 21A is a plot of the power as a function of time of a high frequency continuous signal for driving a wave generator, in accordance with one embodiment of the invention. Signal 2120 in the example of FIG. 21A possesses a sine-shape, however the signal may possess any other signal shape, such as a square, saw tooth, ramp or any other chosen signal shape. The signal may be applied at a constant amplitude of power 2110, either continuously or for any given length of time 2112 at any chosen periodicity. The latter operating regime, i.e. continuous regime, is useful for reducing skin effect in the wellbore, decreasing oil's viscosity and increasing the formation's permeability, and treating wells with formation damage.

Figure 21B:
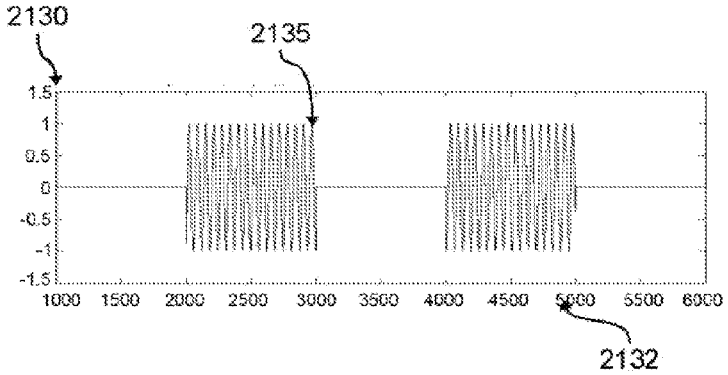
FIG. 21B is a plot of the power as a function of time of a high frequency signal for driving a wave generator, where the signal is applied in an ON/OFF fashion, in accordance with one embodiment of the invention.

FIG. 21B is a plot of the power as a function of time of a high frequency signal for driving a wave generator, where the signal is applied in an ON/OFF fashion, in accordance with one embodiment of the invention. In the latter example of power application, signal 2135 may be applied for any given length of time. Each burst may, for example, have a sine waveform of a constant amplitude 2130, and the burst application may be repeated at a constant or variable rate over time 2132. In the latter regime of operation, a control system (e.g., 110) may intermittently activate and deactivate a high-frequency power source that drive the acoustic wave generator. The latter ON/OFF operation mode is known in the industry of oil well stimulation as "keying".

Figure 21C:
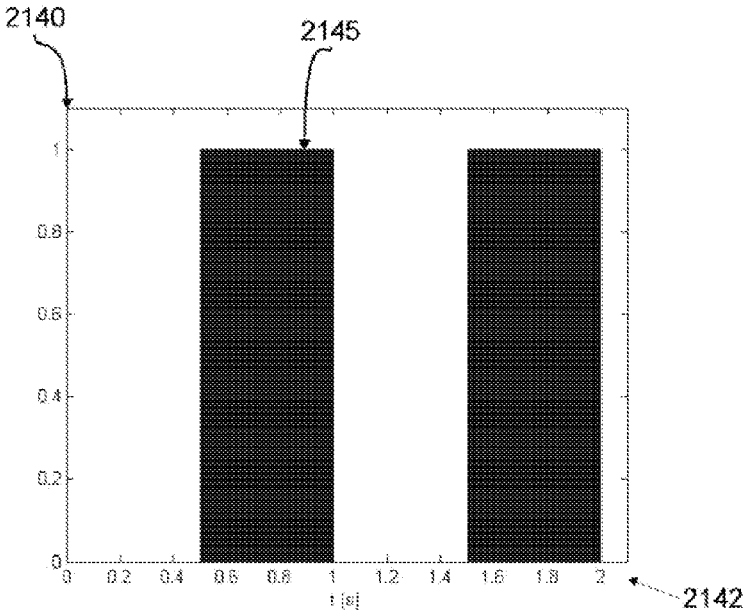
FIG. 21C is a graph showing the power level as a function of time of a high-frequency signal that is applied in a pulsed mode, in accordance with an embodiment of the invention.

FIG. 21C is a graph showing the power level as a function of time of a high-frequency signal that is applied in a pulsed mode, in accordance with an embodiment of the invention. The graph 2145 of FIG. 21C is the power plot of signal 2135. The power of the wave indicated in scale 2140 follows the burst mode as a function of time 2142.

The soil is expected to behave as a natural low-pass filter. At a certain distance, the soil filters the signal, attenuating the high frequency components, thus acting as a demodulator of an amplitude modulated (AM) signal.

Figure 21D:
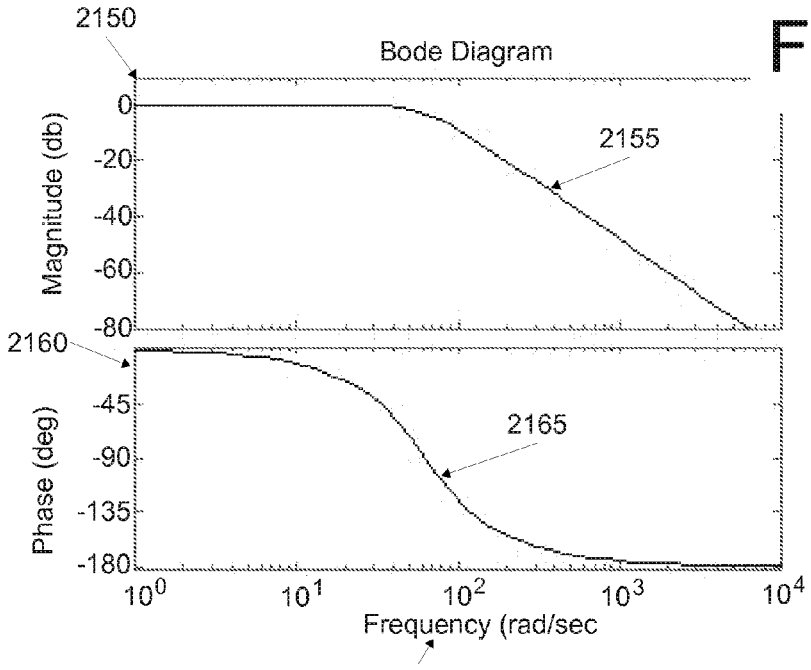
FIG. 21D is a bode diagram showing the magnitude of the signal and the phase of the signal as a function of frequencies of signals propagated through a geological formation in accordance with applications of the invention.

FIG. 21D is a bode diagram showing the magnitude of the signal and the phase of the signal as a function of frequencies of signals propagated through a geological formation in accordance with applications of the invention. Curves 2155 and 2165, respectively, show the magnitude and 2150 and phase 2160 of signals applied to a geological formation as a function of the frequency of the signal 2162 at a given distance from the source where the acoustic wave was initiated. Plot 2150 shows that the power transfer within the geological formation decreases as the frequency of the vibration increases.

Because of the integration properties of a low pass-filters in general, and of the soil with regard to acoustic waves in the present case, a burst of high-frequency waves results in a low frequency power transfer wave.

Figure 21E:
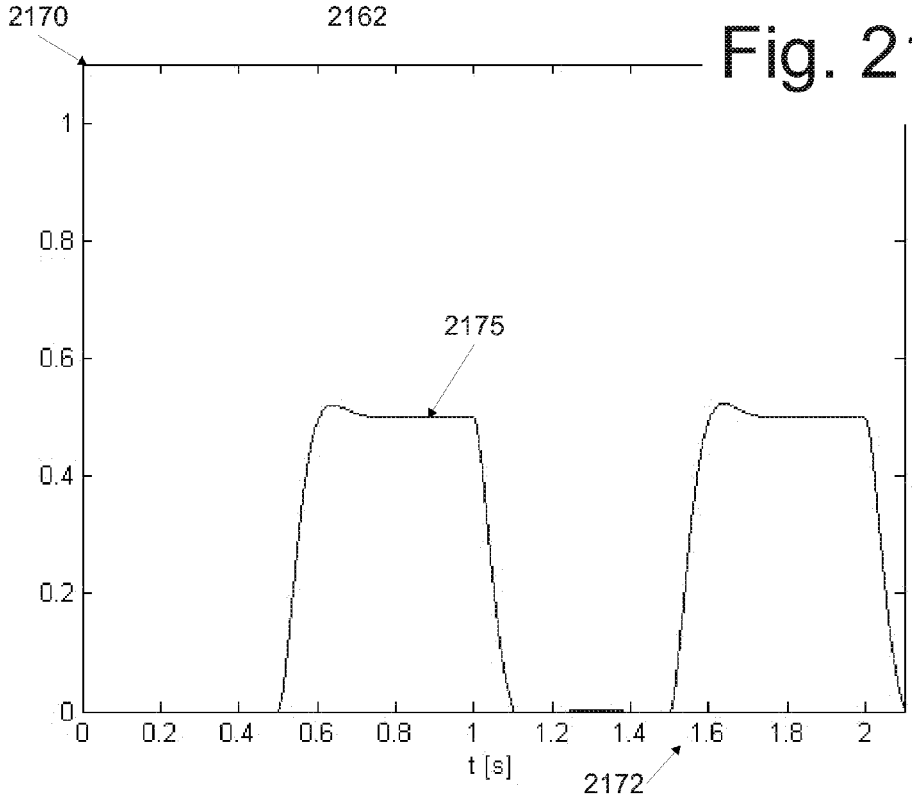
FIG. 21E is a plot of a low frequency wave 2175 resulting from the application of a burst of high-frequency signal.

FIG. 21E is a plot of a low frequency wave 2175 resulting from the application of a burst of high-frequency signal. The amplitude of wave 2175 on a scale of power as a function of time, in this case, has a square-like shape that reflects the short period of application of the high-frequency signal (see FIG. 21B).

Low-frequency acoustic waves are able to travel longer distances. The generation of low-frequency signals provided by a system embodying the invention by modulating high-frequency signals allows for a wide range of application of low-frequency stimulation along with high-frequency stimulation.

The soil's properties to dampen acoustic vibrations amplitude as the vibration frequency increases may modeled as a low-pass filter having a bandwidth of $Bw=[0, f_c]$ Where "$f_c$" is the soil's cutoff frequency, that may vary depending on the type of soil being treated.

This low-pass filter can be modeled as follows:

$$|H(s) = \frac{K}{(s^2/w^2 + 2\xi s/w + 1)}$$

where $w=2\pi f_c$;

and where "H(s)" is the low pass filter transfer function ; "K" is the gain of the filter ,"s" is the frequency domain variable; "ξ" is a damping ratio of the system; and "$f_c$" is cutoff frequency of the low-pass filter.

A system embodying the invention is enabled to exploit the inherent low-pass filter properties of the soil, coupled with the ability of embodiments of the invention to generate and modulate high-frequency signals in order to apply low-frequency acoustic waves to the geological formation.

Figure 22A:
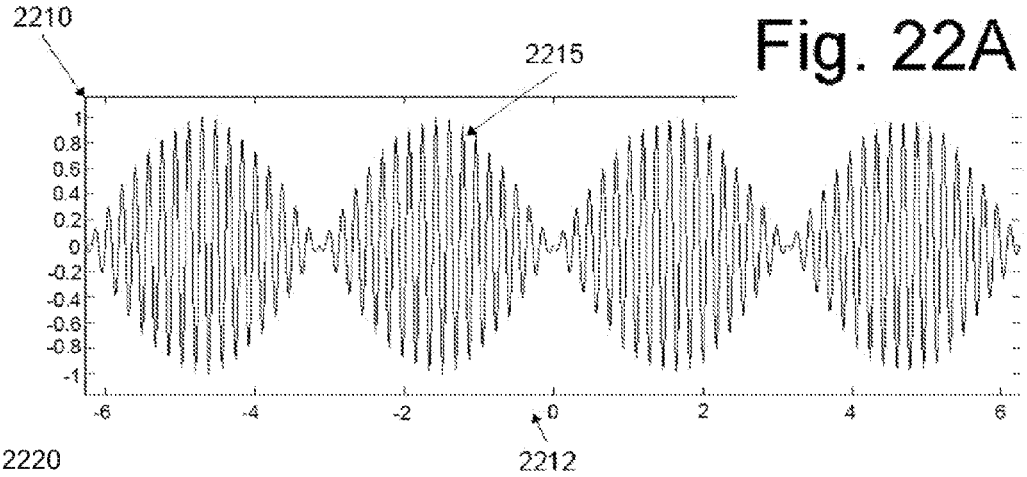
FIG. 22A is a plot of a modulated high frequency signal used to apply low-frequency acoustic vibrations in accordance with an embodiment of the invention.

FIG. 22A is a plot of a modulated high frequency signal used to apply low-frequency acoustic vibrations in accordance with an embodiment of the invention. Signal 2215 is a high-frequency signal whose amplitude is represented on scale 2210 as a function of time 2212. Signal 2215 exhibits a high-frequency component whose amplitude has been modulated at a lower oscillating pattern.

Figure 22B:
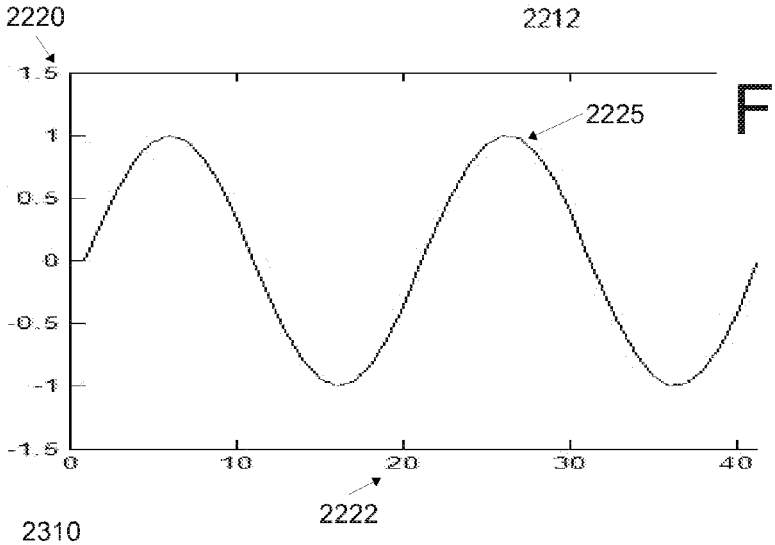
FIG. 22B shows a plot of a signal having a low-frequency that results from the application of the signal shown in FIG. 22A.

FIG. 22B shows a plot of a signal having a low-frequency that results from the application of the signal shown in FIG. 22A. Signal 2225 represents the power transfer waveform as a function of time 2222 on a scale of power 2220. The wave shape of 2225 results from the lower-frequency modulation of the high-frequency signal.

In a system embodying the invention, amplitude modulation can be achieved when the control system regulates the output power of the ultrasonic generator. If the generator gradually periodically decreases and increases the output power repeatedly the amplitude can thus be modulated.

Figure 23:
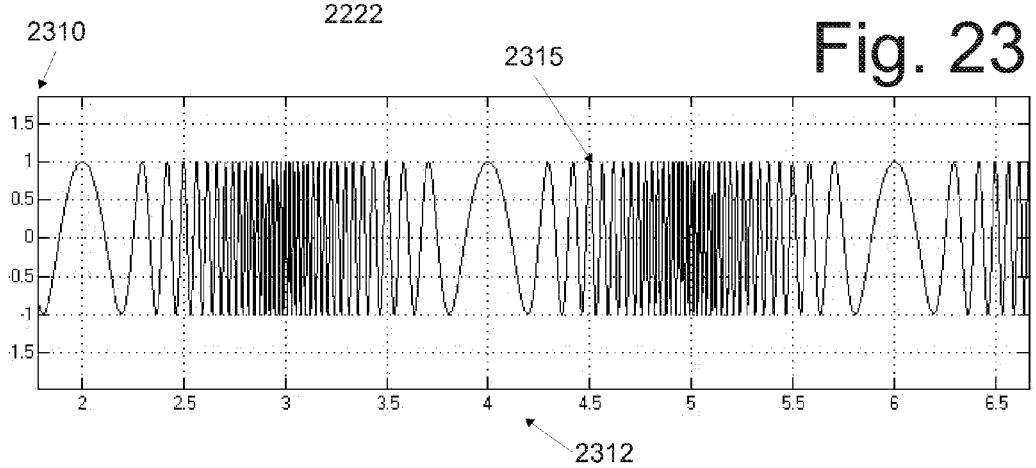
FIG. 23 is a plot representing a signal whose frequency is modulated in accordance with an embodiment of the invention.

FIG. 23 is a plot representing a signal whose frequency is modulated in accordance with an embodiment of the invention. Signal 2315 is a plot of power of the signal on a power scale (e.g., 2310) as a function of time. Using such a frequency modulated signal, coupled with the integration properties of low-pass filter provided by the soil, it is possible to transfer both high and low-frequency vibrations into the geologic formation.

Frequency modulation of signals allows for irradiating in a wide bandwidth; where the user via the control system sets the stimulation bandwidth. This is very useful when information about the treated well is unavailable. This stimulation bandwidth could be for example between 15 kHz to 25 kHz, in this case the control system would gradually increase the ultrasonic generator's frequency from 15 kHz to 25 kHz and then gradually decrease it to 15 kHz, this process may be repeated while the frequency modulation operating regime is enabled.

Pulsed and AM modulated operation, as they radiate high frequency and also low frequency acoustic waves, they are useful to increase the mobility of oils deep into the reservoir, because low frequency acoustic waves travel further than high frequency.

Thus an apparatus, method and system for increasing production of a natural resource producing-well, by utilizing an acoustic waves generating device to deliver vibrational energy to the geological formation and continuously monitoring and optimizing the stimulation parameters.

What is claimed is:

1. An apparatus for stimulating the flow of a natural resource in a geological formation toward the extraction zone of a production well, the apparatus comprising:

at least one acoustic wave generator for generating at least one modulated high-frequency acoustic wave, wherein said at least one acoustic wave generator is configured to apply a low-frequency acoustic wave to a geologic formation by applying bursts of said at least one frequency-modulated acoustic wave;

a generator chamber for hosting said at least one acoustic wave generator, wherein said generator chamber is sealed and pressurized;

a power supply unit for providing electric power to said at least one acoustic wave generator;

a power cable for receiving power from a power source at the ground surface to said power supply; and at least one sensor for capturing well temperature and well pressure data;

a sensor chamber for hosting said at least one sensor, wherein said sensor chamber is connected to said generator chamber through an opening; and a data cable for transmitting said well temperature and pressure data.

2. The apparatus of claim 1 wherein the surfaces of said generator chamber and said sensor chamber are covered with a layer of a corrosion-resistant compound.

3. The apparatus of claim 1 wherein said generator chamber further contains a liquid capable of absorbing heat.

4. The apparatus of claim 1 wherein said at least one acoustic wave generator further comprises a magnetostrictive transducer.

5. The apparatus of claim 1 wherein said at least one acoustic wave generator further comprises an electromagnetic transducer.

6. The apparatus of claim 1 further having a specific resonance wavelength close to the wavelength of said low-frequency acoustic wave.

7. The apparatus of claim 1, wherein said power supply unit further comprising at least one electronic circuit for converting direct electric current to alternating electric current.

8. The apparatus of claim 1, wherein said power supply unit further comprising at least one electronic circuit for automatically delivering power to said at least one acoustic wave generator.

9. The apparatus of claim 8, wherein said power supply unit further comprising at least one electronic circuit for receiving power from a ground surface power source.

10. The apparatus of claim 8, wherein said power supply unit further comprising:

a cable for receiving an electronic signal from a control computer; and at least one electronic circuit for delivering power under the control of said electronic signal received from said control computer.

11. The apparatus of claim 1, wherein said generator chamber further comprising a liquid capable of absorbing heat, and said liquid at least partially surrounding said at least one acoustic wave generator.

12. The apparatus of claim 1, wherein said at least one sensor further comprising a sensor for capturing data about the structural integrity of the chamber wall.

13. The apparatus of claim 1, wherein said power cable further comprises a submersible cable comprising a plurality of electricity conducting cables, each of which having a conductor core, a dielectric and a lead.

14. The apparatus of claim 13, wherein said plurality of electricity conducting cables further comprising a set of triphasic power cables.

15. The apparatus of claim 13 wherein said power cable is further surrounded by an iron-based cover.

16. The apparatus of claim 1, wherein said at least one acoustic wave generator further comprises a piezoelectric transducer for generating elastic waves.

17. The apparatus of claim 1, wherein said at least one acoustic wave generator further comprising at least one amplitude-modulated wave generator.

18. An apparatus for stimulating the flow of a natural resource in a geological formation toward the extraction zone of a production well, the apparatus comprising:

a plurality of acoustic wave generators for generating at least one modulated high-frequency acoustic wave, wherein said plurality of acoustic wave generators is configured to apply a low-frequency acoustic wave to a geologic formation by applying bursts of said at least one modulated high-frequency acoustic wave;

a generator chamber for hosting said plurality of acoustic wave generators, wherein said plurality of acoustic wave generators are mounted within said generator chamber along the longitudinal axis, and wherein the generators of said plurality of generators are distanced from each other by an integer multiple of the wavelength of said low-frequency acoustic wave;

a power supply unit for providing electric power to said plurality of generator;

a power cable for receiving power from a power source at the ground surface to said power supply; and at least one sensor for capturing well temperature and well pressure data;

a sensor chamber for hosting said at least one sensor, wherein said sensor chamber is connected to said generator chamber through an opening;

a data cable for transmitting said well temperature and pressure data.

19. The apparatus of claim 18, wherein said plurality of acoustic wave generators are submerged in a heat-dissipating liquid.

20. The apparatus of claim 18, wherein said plurality of generators are mounted within a distance that is half the wave-length of a wave generated by said plurality of acoustic wave generators from the wall of said generator chamber.

21. The apparatus of claim 18, wherein said plurality of acoustic wave generators are mounted in contact with the walls of said generator chamber.

22. The apparatus of claim 18, wherein each generator of said plurality of generators is connected to the wall of said generator chamber by a waveguide.

23. The apparatus of claim 18, wherein each of said plurality of generators is placed in direct contact with the wall of said generator chamber.

24. The apparatus of claim 18, wherein said plurality of generators are placed without direct contact of the generators of said plurality of generators with the wall of said generator chamber.

* * * * *